US011111060B2

(12) United States Patent
Sorensen et al.

(10) Patent No.: US 11,111,060 B2
(45) Date of Patent: Sep. 7, 2021

(54) FLIP-TOP CLOSURE FOR A CONTAINER

(71) Applicant: Runway Blue, LLC, Alpine, UT (US)

(72) Inventors: Steven M. Sorensen, Alpine, UT (US); David O. Meyers, East Layton, UT (US)

(73) Assignee: Runway Blue, LLC, Alpine, UT (US)

( * ) Notice: Subject to any disclaimer, the term of this patent is extended or adjusted under 35 U.S.C. 154(b) by 191 days.

(21) Appl. No.: 15/957,775

(22) Filed: Apr. 19, 2018

(65) Prior Publication Data

US 2018/0237191 A1 Aug. 23, 2018

Related U.S. Application Data

(62) Division of application No. 15/017,247, filed on Feb. 5, 2016, now abandoned.

(51) Int. Cl.

| | |
|---|---|
| ***B65D 47/08*** | (2006.01) |
| ***B65D 51/24*** | (2006.01) |
| ***B65D 25/56*** | (2006.01) |

(52) U.S. Cl.

CPC ..... *B65D 47/0895* (2013.01); *B65D 25/56* (2013.01); *B65D 51/242* (2013.01)

(58) Field of Classification Search

CPC ..... B65D 23/108; B65D 25/2835; B65D 25/2841; B65D 25/2844; B65D 25/2852; B65D 25/2858; B65D 25/32; B65D 25/325; B65D 25/40; B65D 43/02; B65D 47/08; B65D 47/0857; B65D 47/0876; B65D 47/088; B65D 47/0885; B65D 47/089; B65D 47/0895; B65D 51/242; B65D 2251/1008; B65D 2251/1016

See application file for complete search history.

(56) References Cited

U.S. PATENT DOCUMENTS

| | | | |
|---|---|---|---|
| 1,037,051 | A | 8/1912 | Ramsey |
| 1,094,469 | A | 4/1914 | Pick |
| 1,389,732 | A | 9/1921 | Baron |

(Continued)

FOREIGN PATENT DOCUMENTS

| | | |
|---|---|---|
| CN | 201139196 | 10/2008 |
| GB | 2135957 A | 9/1984 |
| JP | 2006103793 | 4/2006 |
| JP | 2008247404 | 10/2008 |

OTHER PUBLICATIONS

Kor One, http://www.korwater.com/buyONE, accessed Apr. 20, 2010, 1 page.

(Continued)

*Primary Examiner* — Patrick M. Buechner
(74) *Attorney, Agent, or Firm* — Sterne. Kessler, Goldstein & Fox P.L.L.C.

(57) ABSTRACT

A lid may be sized and configured to be attached to a container and the lid may include a spout and a flip-top closure. The flip-top closure may be movable between open and closed positions relative to the spout. The lid may also include a carrying member with a loop-shaped configuration. The lid may further include one or more flanges and the flanges may include one or more protrusions. The protrusions may form a pivot point about which the flip-top closure pivots between the open and closed positions. The protrusions may also allow the carrying member to pivot independently of the flip-top closure.

14 Claims, 17 Drawing Sheets

(56) References Cited

U.S. PATENT DOCUMENTS 1,479,053 A 4/1924 Brooks
1,573,620 A 2/1926 Allston
2,056,879 A 10/1936 Winterhalter et al.
2,272,867 A 1/1942 Cobel
2,514,573 A 7/1950 Harrison
2,573,378 A 10/1951 Zurlinden
2,574,876 A 11/1951 Lebus
2,575,299 A 11/1951 Scheel
2,638,253 A 5/1953 Mueller
2,748,997 A 6/1956 Richmond, Sr.
2,752,971 A 7/1956 Tupper
2,754,866 A 7/1956 Coltman, Jr.
3,022,925 A 2/1962 Daniell
3,091,361 A 5/1963 Gawron
3,143,205 A 8/1964 Ruderian
3,144,016 A 8/1964 Basci
3,168,226 A 2/1965 Underwood et al.
3,369,691 A 2/1968 Wei
3,552,548 A 1/1971 Wallestad et al.
3,770,160 A 11/1973 Flider
3,820,692 A 6/1974 Swett et al.
D233,116 S 10/1974 Swett et al.
4,022,352 A 5/1977 Pehr
4,136,799 A 1/1979 Albert
4,158,902 A 6/1979 Chernack et al.
D261,088 S 10/1981 Akimov et al.
4,399,926 A 8/1983 Eidels-Dubovoy
4,457,458 A 7/1984 Heinol
4,474,303 A 10/1984 Maccise
4,519,518 A 5/1985 Wiles et al.
4,537,044 A 8/1985 Putnam
4,666,068 A * 5/1987 Bush ..... B65D 47/0885 16/224
4,717,050 A * 1/1988 Wright ..... B65D 47/0885 220/259.2
4,735,333 A 4/1988 Lay et al.
4,776,501 A 10/1988 Ostrowsky
4,805,790 A 2/1989 Leonetti et al.
4,932,225 A 6/1990 Bighouse
5,065,877 A 11/1991 Karppinen et al.
5,065,911 A 11/1991 Rohr et al.
5,088,614 A 2/1992 Dumestre
D330,862 S 11/1992 Shibley et al.
5,228,584 A 7/1993 Williams, Jr.
D342,898 S 1/1994 Cane
5,289,930 A 3/1994 Inouye
D350,460 S 9/1994 Picozza et al.
5,386,922 A 2/1995 Jordan
D356,499 S 3/1995 Cautereels et al.
5,547,111 A 8/1996 Geiger et al.
5,609,277 A 3/1997 McDonald
D382,968 S 8/1997 Giles et al.
D404,305 S 1/1999 De Baschmakoff
D405,654 S 2/1999 Moran
D421,547 S 3/2000 Demers
6,161,713 A 12/2000 Krich
6,283,333 B1 9/2001 Knickerbocker et al.
6,299,005 B1 10/2001 Higgins
6,379,032 B1 4/2002 Sorensen
D458,081 S 6/2002 Bodum
D461,420 S 8/2002 Kerman
D497,431 S 10/2004 Bentley
6,832,412 B2 12/2004 Kim
6,860,397 B1 3/2005 Walters, Jr.
D504,273 S 4/2005 Ancona
D508,185 S 8/2005 Gauss
D510,235 S 10/2005 Sorensen
D518,336 S 4/2006 Hirani
7,073,678 B1 7/2006 Dibdin et al.
D526,827 S 8/2006 Allen et al.
D528,862 S 9/2006 Li
D529,339 S 10/2006 Carreno et al.
D532,650 S 11/2006 de Groote
D543,454 S 5/2007 Leoncavallo et al.
D546,131 S 7/2007 Morales
D547,607 S 7/2007 Forsman
D565,353 S 4/2008 Rothe et al.
D574,190 S 8/2008 Homma
D580,227 S 11/2008 Roth et al.
D586,184 S 2/2009 Miller et al.
D587,069 S 2/2009 Bodum
D589,751 S 4/2009 Lui et al.
D592,913 S 5/2009 Pinelli et al.
7,533,783 B2 5/2009 Choi et al.
D593,811 S 6/2009 Carreno
D599,664 S 9/2009 Fujinami et al.
D604,103 S 11/2009 Alviar et al.
D609,970 S 2/2010 Richau et al.
D613,110 S 4/2010 Lane et al.
D622,089 S 8/2010 Daniel et al.
D622,554 S 8/2010 Carreno
7,806,284 B2 10/2010 Mangano
D626,837 S 11/2010 Meyers et al.
D626,838 S 11/2010 Meyers et al.
D628,483 S 12/2010 McKinney et al.
D629,657 S 12/2010 Carreno
7,870,980 B2 1/2011 Wilson et al.
D641,594 S 7/2011 Huang
D644,065 S 8/2011 Llerena
8,020,257 B2 9/2011 Merten et al.
D646,546 S 10/2011 Robinson et al.
D646,919 S 10/2011 Nilsson
D647,760 S 11/2011 Pearson
D652,256 S 1/2012 Eyal
D655,131 S 3/2012 Nilsson
D655,967 S 3/2012 Bodum
D656,357 S 3/2012 Enghard
D658,445 S 5/2012 Carreno
D661,551 S 6/2012 Gilbert
D666,047 S 8/2012 Lin
D666,061 S 8/2012 Ying
D667,694 S 9/2012 Meyers et al.
8,302,796 B1 11/2012 Johnson
8,342,349 B2 1/2013 Lu
D677,121 S 3/2013 Meyers et al.
D686,885 S 7/2013 Meyers et al.
D686,886 S 7/2013 Meyers et al.
D686,887 S 7/2013 Meyers et al.
D686,888 S 7/2013 Meyers et al.
D696,079 S 12/2013 Meyers et al.
D696,551 S 12/2013 Meyers et al.
D697,798 S 1/2014 Sorensen et al.
8,695,830 B2 4/2014 Meyers et al.
8,833,586 B2 9/2014 Meyers et al.
8,844,746 B2 9/2014 Meyers et al.
8,939,305 B2 1/2015 Meyers et al.
9,120,598 B2 9/2015 Meyers et al.
D742,230 S 11/2015 Charles
9,216,843 B2 12/2015 Sorensen et al.
D748,478 S 2/2016 Sorensen et al.
D771,990 S 11/2016 Horowitz
9,492,024 B2 11/2016 Meyers et al.
2002/0074334 A1 6/2002 Karp
2003/0085228 A1 5/2003 Oakes
2004/0217139 A1 11/2004 Roth et al.
2004/0262306 A1 12/2004 Smith
2005/0045634 A1 3/2005 Ward et al.
2005/0045636 A1 3/2005 Lown et al.
2006/0255036 A1* 11/2006 Chau ..... A45F 3/16 220/254.3
2007/0012693 A1 1/2007 Kummer
2007/0175931 A1 8/2007 Leoncavallo et al.
2008/0099514 A1 5/2008 Carter et al.
2009/0178940 A1 7/2009 Said
2009/0188884 A1 7/2009 Nelson et al.
2009/0188933 A1 7/2009 Daams
2009/0301990 A1 12/2009 Cresswell et al.
2010/0187235 A1 7/2010 Chen
2010/0200438 A1 8/2010 Davies
2010/0206835 A1 8/2010 Yu
2010/0224631 A1 9/2010 Roth et al.
2010/0282703 A1 11/2010 Yang
2011/0017760 A1 1/2011 Newman
2011/0083300 A1 4/2011 Heger et al.

(56) References Cited

U.S. PATENT DOCUMENTS

| | | | | |
|---|---|---|---|---|
| 2011/0253733 | A1 | 10/2011 | Meyers et al. | |
| 2014/0069918 | A1 | 3/2014 | Meyers et al. | |
| 2016/0264312 | A1 | 9/2016 | Choltco-Devlin | |
| 2016/0355305 | A1* | 12/2016 | Hoskins | B65D 47/066 |
| 2017/0129665 | A1* | 5/2017 | Rolfes | B65D 51/2821 |
| 2019/0100362 | A1* | 4/2019 | Meyers | B65D 47/0866 |
| 2019/0344934 | A1* | 11/2019 | Faerber | B65D 53/04 |

OTHER PUBLICATIONS 2,ore 77, http://www.core77.com/blog/materials/kor.sub.—one_sub.--watersub.—vessel.sub.—actual_sub.--size. sub.-10211.asp, accessed Apr. 20, 2010, 6 pp.

Koyono, http://www.koyono.com/KOR-ONE-Green-Zen-Water-Hydration-Vessel.sub--.—p/kor-one.htm, accessed Apr. 20, 2010, 7 pages.

Fit Sugar, www.fitsugar.com/2496788, accessed Apr. 20, 2010, 10 pages.

Goodlifter, http://goodlifter.com/2009/02/360-paper-water-bottle/, accessed Apr. 20, 2018, 9 pages.

Thermos, http://www.shopthermos.com/detail/TMS+HP4000GR6, accessed Apr. 20, 2010, 1 page.

International Search Report and Written Opinion from PCT Application No. PCT/US2013/047161 dated Nov. 20, 2013, 9 pages.

International Search Report from PCT Application No. PCT/US2011/026508 dated Sep. 29, 2011, 3 pages.

Written Opinion from PCT Application No. PCT/US2011/026508 dated Sep. 29, 2011, 3 pages.

International Search Report and Written Opinion from PCT Application No. PCT/US2013/052132 dated Aug. 16, 2013, 14 pages.

International Search Report from PCT Application No. PCT/US2012/054483 dated Nov. 16, 2012, 12 pages.

International Search Report from PCT Application No. PCT/US2012/054497 dated Nov. 20, 2012, 3 pages.

* cited by examiner

FLIP-TOP CLOSURE FOR A CONTAINER

CROSS-REFERENCE TO RELATED APPLICATION

The present application is a divisional application of U.S. patent application Ser. No. 15/017,247, filed Feb. 5, 2016. The Ser. No. 15/017,247 application is incorporated herein by reference.

BACKGROUND

Field of the Invention

The present invention generally relates to lids and, in particular, to a flip-top closure for a container.

Description of Related Art

Conventional containers may hold a variety of different types of liquids and fluids. For instance, known containers may hold water, beverages, liquid refreshments, sodas, juices, thirst-quenchers, and the like.

Known containers may be used in a wide variety of environments such as at home, office, gym or health club, and while traveling. Known containers may also be used during activities such as exercising, driving a car, or riding in an automobile, bus, train, or airplane. Containers are also used in other situations and environments such as at work, at job sites, and while performing various tasks and trades.

Many known containers include a body or vessel for holding a fluid and a lid to prevent the fluid from spilling. There are a number of known types of closures to prevent fluid from spilling such as internally threaded bottle caps, externally threaded screw caps or tops, stoppers, toggle or swing-type closures, crown caps, flip-tops, and friction or interference fit lids.

Often times it is desirable for the lid to create a fluid-tight seal to prevent the contents of the container from leaking. Some conventional lids that are fluid-tight, however, are difficult or inconvenient to use. In addition, many known lids may include grooves or crevices in which particles or materials may get stuck or caught in during use. Further, some known lids may be difficult to use or clean because of the shape, number of parts, complex configuration, and interconnection of the components.

In some instances, conventional containers may hold fluids that require mixing. For example, conventional containers may hold powdered drinks, electrolyte pills, energy drinks, baby formulas, pancake batters, crepe mixes, baking materials, dietary supplements, salsa, sauces, oil and vinegar, salad dressings, smoothies, and the like. These types of containers that hold fluids for mixing may require the lid to be securely closed and the lid to be fluid-tight so that fluid does not leak from the lid.

Some known containers that are designed to mix ingredients by shaking the container may include lids that are difficult and time consuming to open and close. For example, the lid may be screwed on the container and the user may have to unscrew the lid to dispense the contents, which may be especially difficult for users with limited agility or dexterity. Some known containers may also not prevent the contents from leaking when shaking the container.

BRIEF SUMMARY OF THE INVENTION

A need therefore exists for an apparatus or device that eliminates the above-described disadvantages and problems.

One aspect is a lid for a container that may be used with a wide variety of liquids and fluids such as water, soda, liquid refreshments, etc. In particular, the container could hold one or more liquids, beverages, drinks, juices, vitamin-enhanced beverages, energy drinks, thirst-quenchers, flavored waters, and the like. Additionally, the container could hold various powders, mixtures, and/or solutions, which could include vitamins, supplements, powdered drinks, electrolyte pills, protein powders, medicinal products, baby formulas, etc. If desired, the container could also hold solids and/or other types of materials including foodstuffs such as fruits, vegetables, soups, dressings, sauces, batters, baking materials, and the like. The container could further hold non-edible fluids, which could include paint, household cleaners, etc.

Another aspect is a lid for a container that may allow the contents to be stirred, shaken, mixed, and/or blended as desired. This may allow protein drinks, shakes, smoothies, dressings, sauces, etc. to be created and/or stored within the container. Advantageously, the lid and container may be reusable and refillable, which may allow the lid and container to be used for many different purposes over an extended period of time. The container may also be easily carried and portable. For example, the container may be conveniently held in one-hand by the user. If desired, the container may be insulated to help keep the contents at a desired temperature, such as at a lower or higher temperature. Further, the lid and container may include a small number of parts and components, which may facilitate manufacturing and assembly. The small number of parts and components may also facilitate cleaning and may make the lid and container easier to use.

Still another aspect is a lid that may be quickly and easily coupled to a container. If desired, the lid may be easily attached and/or detached from the container, which may allow the lid and container to be easily cleaned. The lid may also allow the container to be easily filled from various sources. Advantageously, the lid may be connected to containers of different types, sizes, shapes, and configurations, depending, for example, upon the intended use of the container. In addition, the lid and container may be used or sold in combination or the lid and container may be independently used or sold.

Yet another aspect is a lid that may be constructed from plastic. For example, the lid may be constructed from injection molded plastic. The lid, however, may also be constructed from other suitable processes such as compression molding, blow molding, rotational molding, thermoforming, and the like. It will also be appreciated that the lid may be constructed from other materials with suitable characteristics and properties such as metals, composites, and the like. Advantageously, the lid may be attached to containers made from plastic, glass, metal, and the like. The lid may be constructed from relatively few parts, which may allow the lid to be quickly and efficiently manufactured. For example, the lid may include a lower portion that is sized and configured to be connected to the container. The lower portion of the lid may include internal threads to allow the lid to be threadably connected to a container. In addition, the lid may be attached to the container with a fluid or water-tight seal, which may help prevent the contents from leaking or spilling. Further, the lid may cover a relatively large opening to allow the container to be easily filled, cleaned, and washed. While the lid is preferably selectively attached to the container, the lid could be permanently attached to the container.

Still yet another aspect is a lid that may include an opening or spout. The opening may provide direct access to the container and the opening may be sized and configured to allow a user to drink and/or pour from the container. The opening may be large enough to allow the contents to easily be poured or dispensed and the opening may be disposed toward a periphery or outer edge of the lid. In addition, the opening may be surrounded by a flange that projects upwardly from an upper surface of the lid to form a spout. It will be appreciated after reviewing this disclosure that the opening and spout could have various shapes, sizes, configurations and arrangements depending, for example, upon the intended use of the lid and/or container. It will also be appreciated after reviewing this disclosure that the lid may include any suitable number of openings, apertures, and spouts.

A further aspect is a lid that may include flip-top closure. The flip-top closure may be pivotally connected to the lid and movable between an open position in which an opening is exposed and fluid can pass through the opening, and a closed position in which the opening is covered or closed. The flip-top closure may create a water or fluid-tight seal in the closed position. The flip-top closure may include a fitting, such as a plug or projection, which is sized and configured to be at least partially disposed inside the opening when the flip-top is in the closed position. The fitting may include a lower surface that is generally aligned with an inner surface of the lid, which may help prevent fluids and other materials from entering the opening when the flip-top is closed.

Another further aspect is flip-top closure that may include an elongated body that is sized and configured to be pivotally connected to a lid. For example, a first end of the flip-top closure may be pivotally connected to the lid and a second end may be sized and configured to close the opening when the flip-top is in the closed position. In greater detail, the flip-top closure may include a fitting that is sized and configured to be at least partially disposed inside the opening or spout when the flip-top closure is in the closed position. A lower surface of the fitting may be disposed immediately adjacent and/or generally parallel to an inner surface of the lid when the flip-top closure is in the closed position. In addition, the flip-top closure may include a protecting member that encloses at least a portion of the fitting. A gap may be disposed between an outer surface of the fitting and an inner surface of the protecting member, and the spout may be at least partially disposed in the gap when the flip-top closure is in the closed position. Advantageously, the protecting member may comprise a guard that is sized and configured to prevent a user from touching the spout or the fitting when opening the flip-top closure from the closed position. If desired, the fitting and the protecting member may have generally cylindrical configurations, and the fitting and the protecting member may be aligned along the same central axis. When the flip-top closure is in the closed position, at least a portion of the spout may be sandwiched between the protecting member and the fitting.

Still another further aspect is a lid that may include a flip-top closure and a carrying member. The carrying member may have a loop-shaped configuration and the carrying member may pivot independently relative to the flip-top. The lid, for example, may include two generally parallel flanges and each flange may include a protrusion. The protrusions may extend towards each other, be aligned along an axis, and spaced apart by a gap. The protrusions may form pivot points about which the flip-top closure may pivot between open and closed positions. In greater detail, the carrying member may include receiving portions and the protrusions may be disposed in the receiving portions of the carrying member. The flip-top closure may also include receiving portions and the protrusions may be disposed in the receiving portions of the flip-top closure. Alternatively, in another exemplary embodiment, the flip-top closure may include receiving portions that are sized and configured to receive the protrusions from the flanges. The flip-top closure may include inwardly extending flanges that are disposed in receiving portions of the flip-top closure. The protrusions and receiving portions may form pivot points about which the carrying member and flip-top closure may pivot. Advantageously, the flip-top closure and the carrying member may pivot independently.

One of ordinary skill in the art, after reviewing this disclosure, will appreciate that the lid, container, and flip-top closure could include any suitable number of parts and components. In addition, one of ordinary skill in the art, after reviewing this disclosure, will appreciate that the lid, container, and flip-top closure could have other appropriate shapes, sizes, configurations and arrangements depending, for example, upon the intended use of the lid or container.

These and other aspects, features, and advantages of the present invention will become more fully apparent from the following brief description of the drawings, the drawings, the detailed description of preferred embodiments, and appended claims.

BRIEF DESCRIPTION OF THE DRAWINGS

The appended drawings contain figures of preferred embodiments to further illustrate and clarify the above and other aspects, advantages, and features of the present invention. It will be appreciated that these drawings depict only preferred embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE PREFERRED EMBODIMENTS

The present invention is generally directed towards a lid for a container. The principles of the present invention, however, are not limited to lids for containers. It will be understood that, in light of the present disclosure, the lids and containers disclosed herein may have a variety of shapes, sizes, configurations, and arrangements. It will also be understood that lids and containers may include any suitable number and combination of features, components, aspects, and the like. In addition, while the lids and containers shown in the accompanying figures are illustrated as having particular styles and configurations, it will be appreciated that the lids and containers may have any suitable styles or configurations. Further, the lids and containers disclosed herein may be successfully used in connection with other types of objects and devices.

Additionally, to assist in the description of various exemplary embodiments of the lids and containers, words such as top, bottom, front, rear, right, and left are used to describe the accompanying figures which may be, but are not necessarily, drawn to scale. It will be further appreciated that the disclosed exemplary embodiments of the lids and containers may be disposed in a variety of positions or orientations, and used in numerous locations, environments, and arrangements.

Exemplary embodiments of the lids and containers are disclosed and described in detail below. It will be understood that different embodiments may have one or more different parts, components, features and aspects; and the different parts, components, features and aspects may not be required. Further, it will be understood that different embodiments may include various combinations of these parts, components, features and aspects depending, for example, upon the intended use of the lids and containers.

Figure 1:
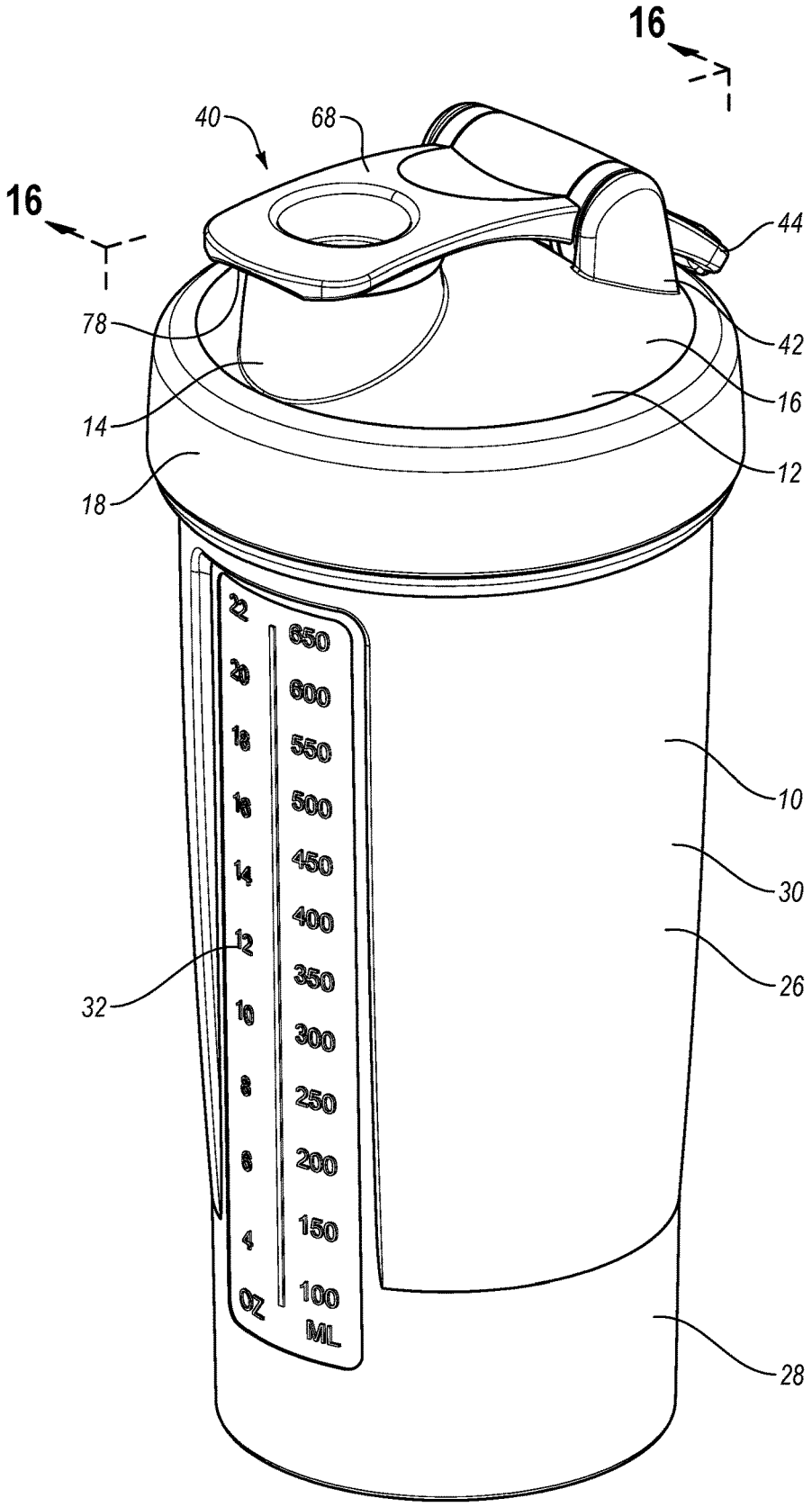
FIG. 1 is a perspective view of an exemplary container and lid, illustrating the lid in a closed position.

As shown in FIG. 1, an exemplary embodiment may include a container 10 and the container may be sized and configured to hold one or more liquids or fluids such as water, flavored water, juices, vitamin-enhanced beverages, energy drinks, thirst-quenchers, soda, and the like. The container 10 can also hold mixtures or solutions such as vitamins, supplements, powdered drinks, electrolyte pills, protein powders, medicinal products, baby formulas, etc. The container 10 could also hold foodstuffs such as fruits, vegetables, soups, dressings, sauces, smoothies, batters, baking materials, and the like. In addition, the container 10 could include non-edible materials such as paints, cleaners, etc. Thus, the container 10 could hold a variety of items, such as liquids, fluids, and/or solids, depending, for example, upon the intended use of the container 10.

A lid 12 may be attached to the container 10 and the lid may include an opening or spout 14. The spout 14 may be disposed in an upper surface 16 of the lid 12 and the spout may be disposed at least proximate an outer wall 18 or skirt of the lid. In greater detail, the spout 14 may include an opening in the upper surface 16 of the lid 12 and an upwardly extending flange. The spout 14 may have a cylindrical or tubular-shaped configuration with a generally planar upper surface, as described in more detail below.

Figure 2:
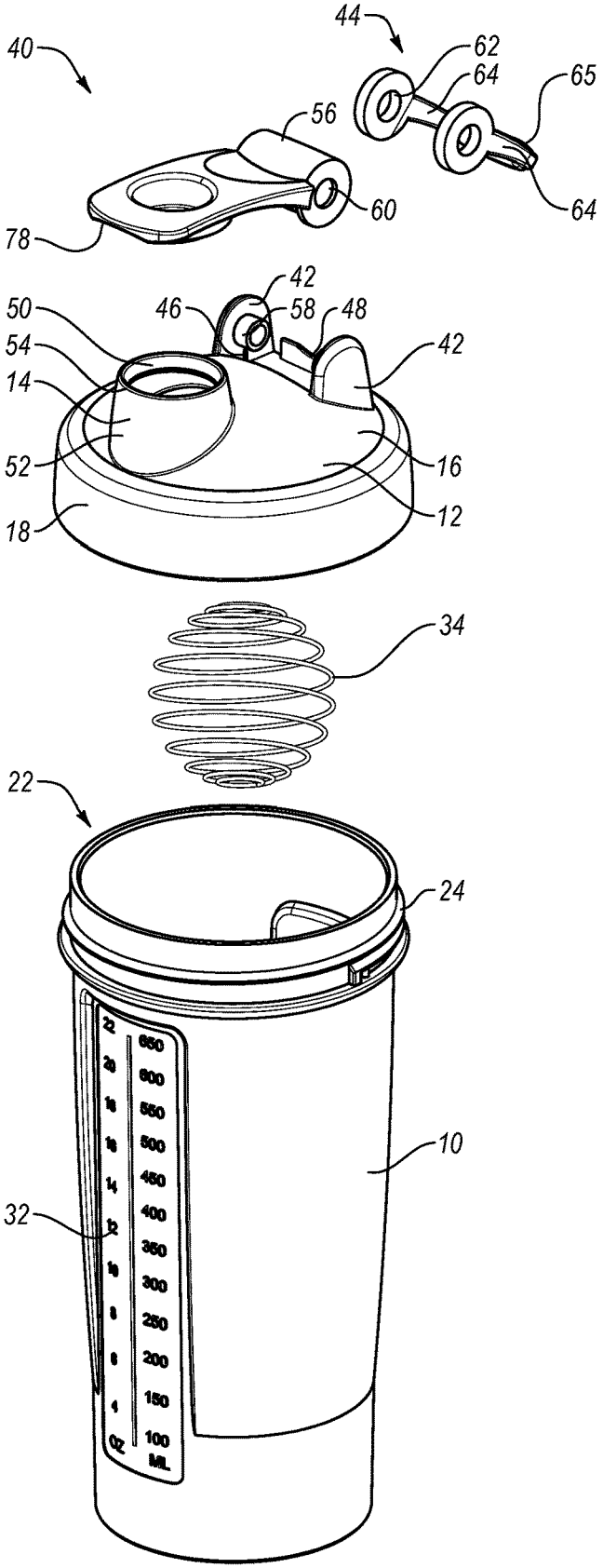
FIG. 2 is an exploded perspective view of the container and lid shown in FIG. 1.
Figure 3:
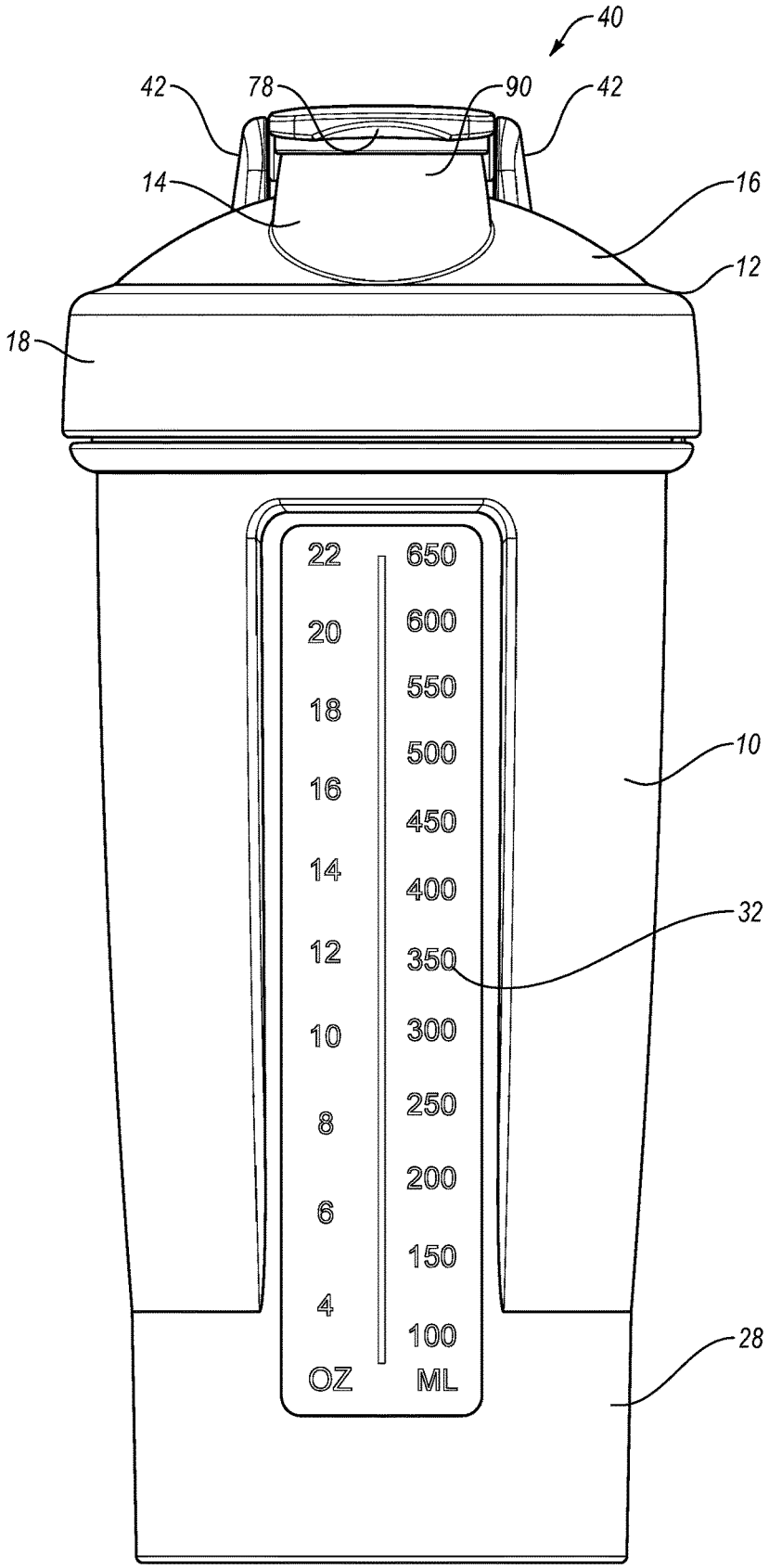
FIG. 3 is a front view of the container and lid shown in FIG. 1.
Figure 4:
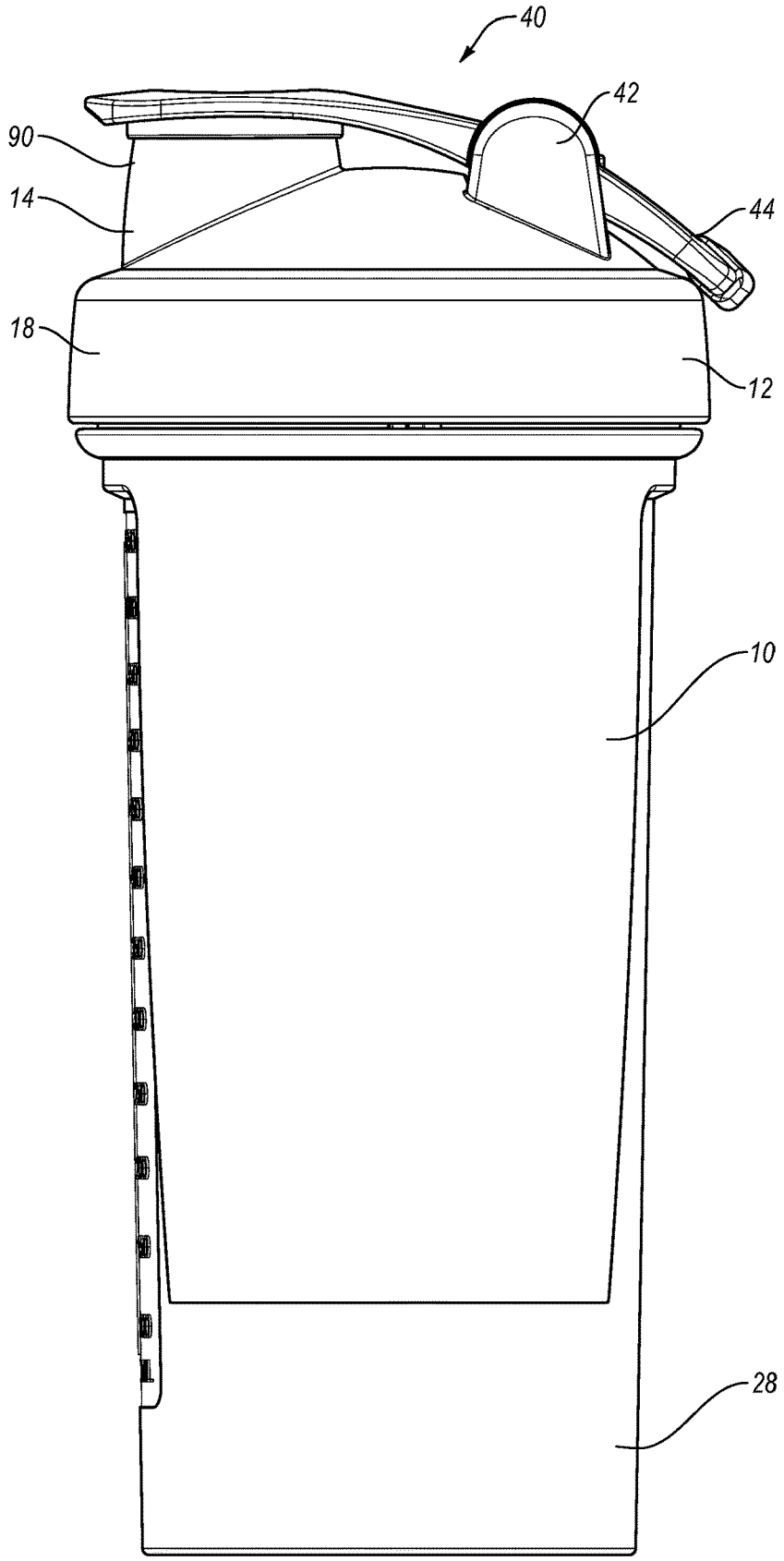
FIG. 4 is a right side view of the container and lid shown in FIG. 1.
Figure 5:
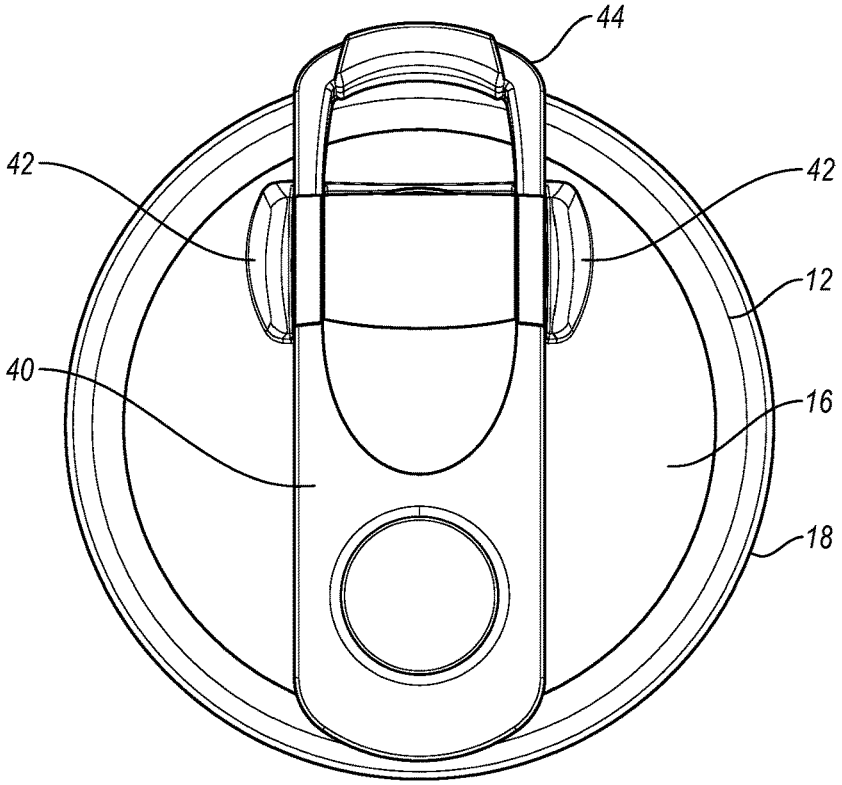
FIG. 5 is a top view of the container and lid shown in FIG. 1.
Figure 6:
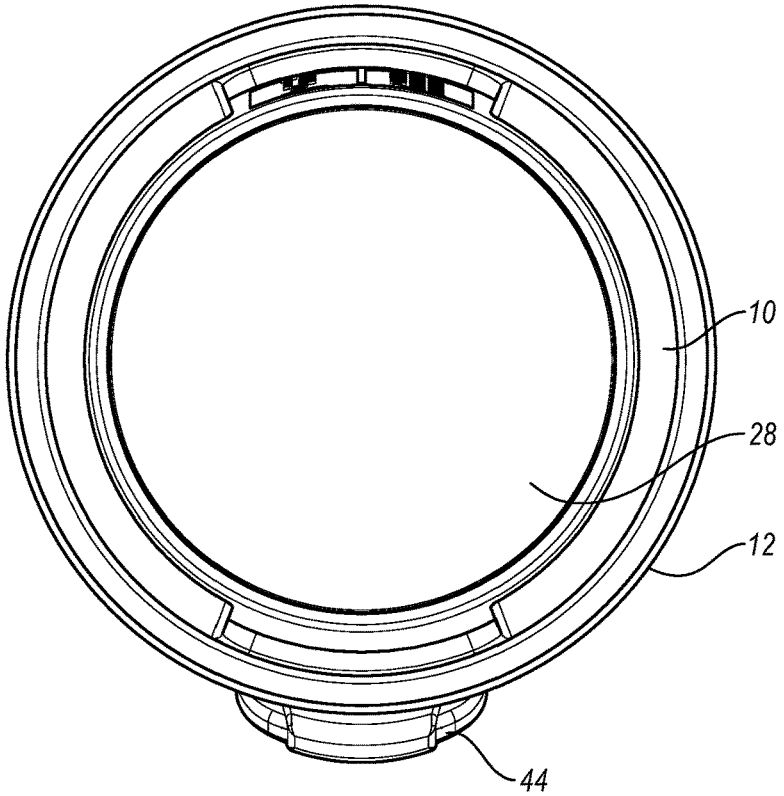
FIG. 6 is a bottom view of the container and lid shown in FIG. 1.
Figure 15:
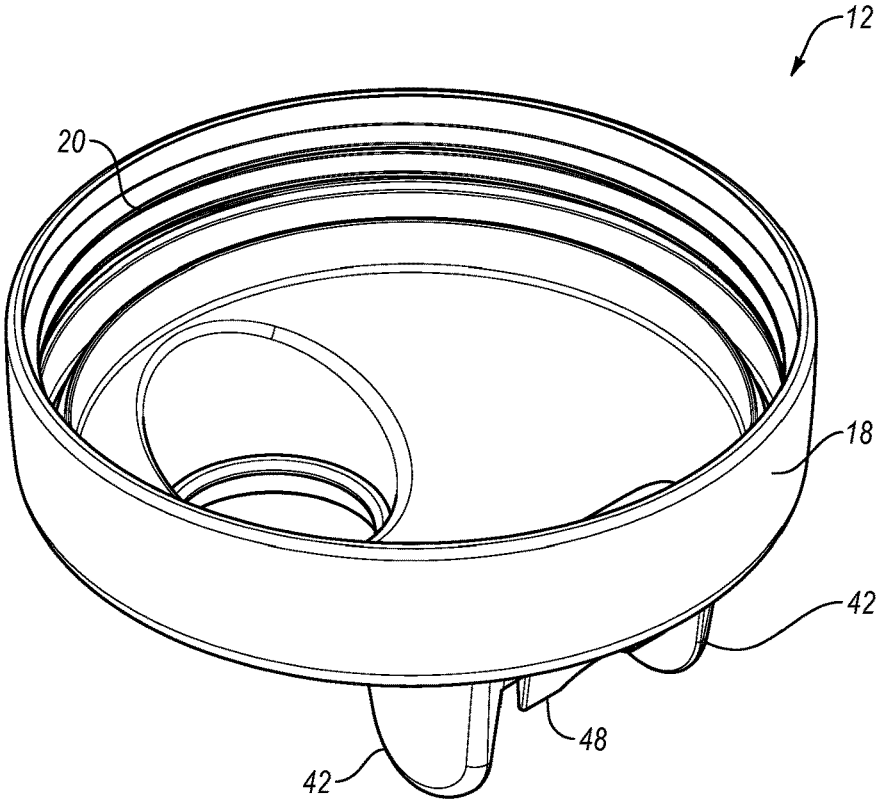
FIG. 15 is a lower perspective view of the lid shown in FIG. 14.
Figure 16:
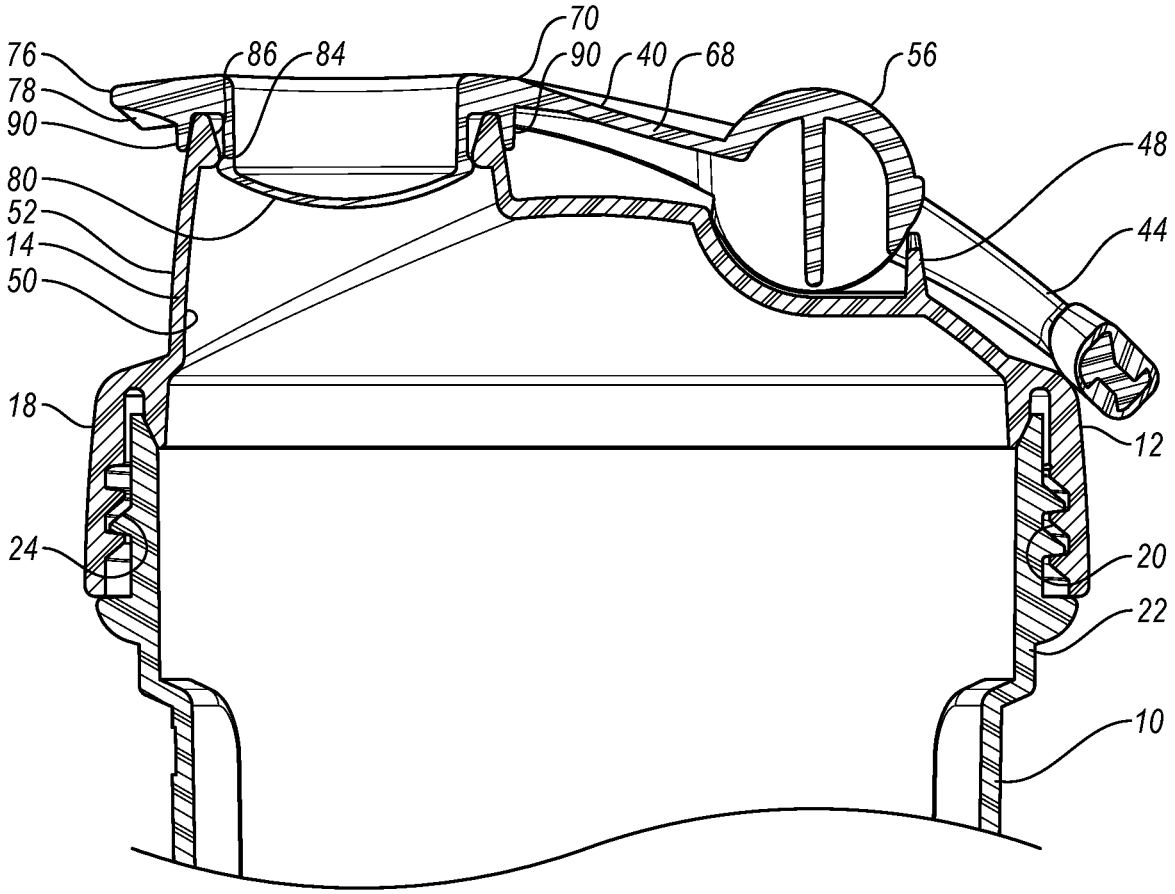
FIG. 16 is a cross-sectional side view along lines 16-16 of the container and lid shown in FIG. 1.
Figure 17:
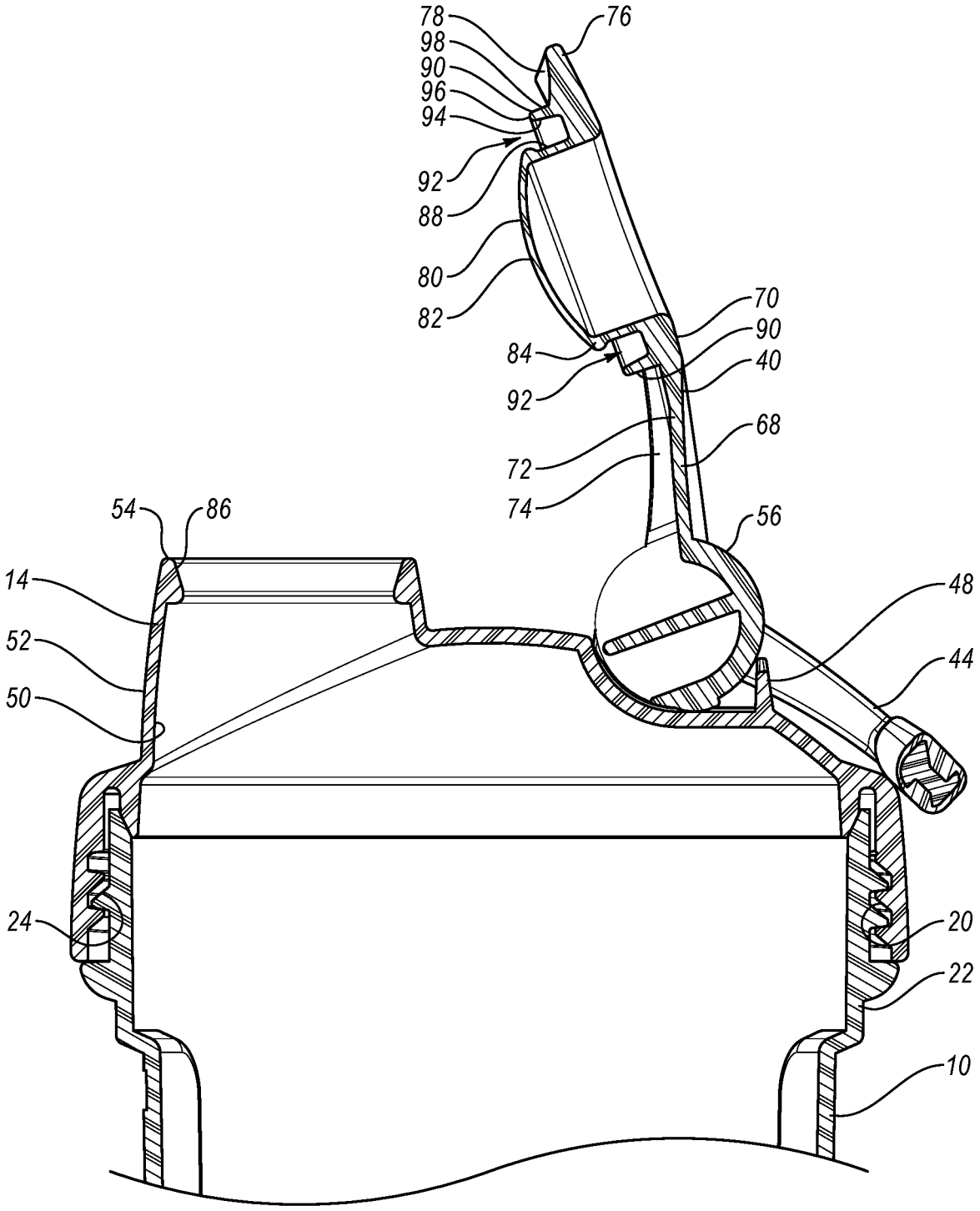
FIG. 17 is a cross-sectional side view along lines 17-17 of the container and lid shown in FIG. 7.
Figure 18:
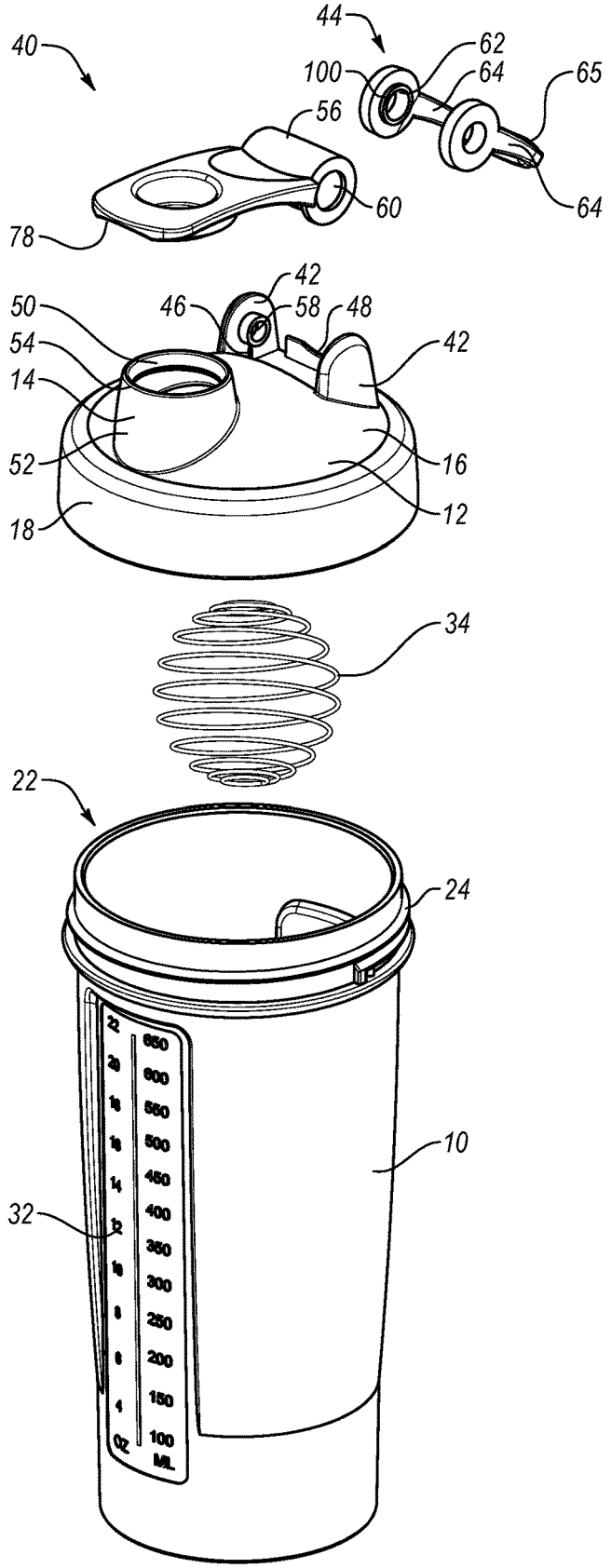
FIG. 18 is an exploded perspective view of another exemplary container and lid.
Figure 19:
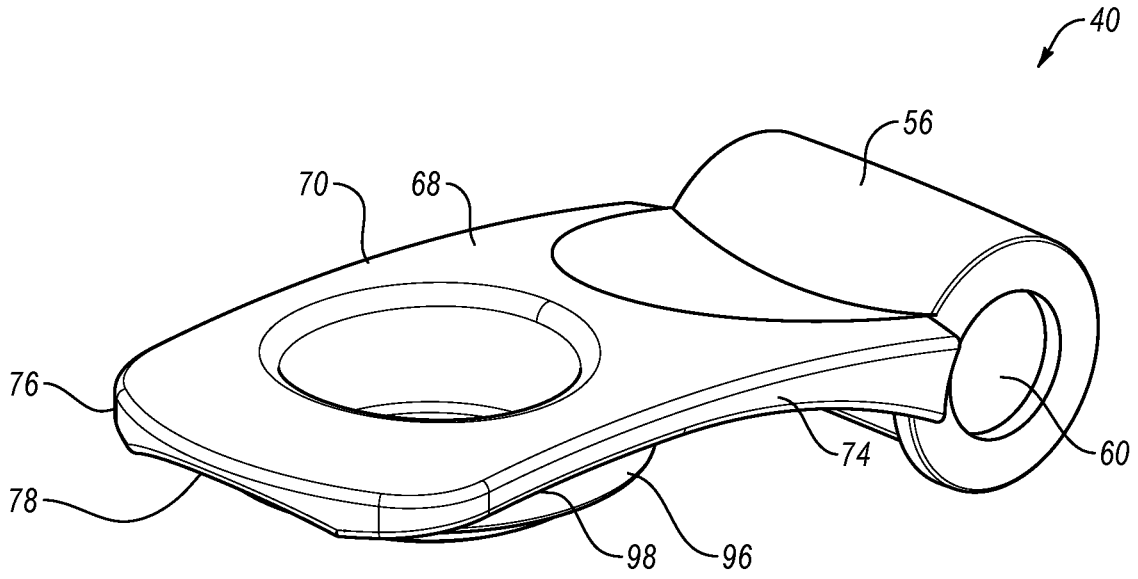
FIG. 19 is an upper perspective view of a flip-top closure of the container and lid shown in FIG. 18.

The lid 12 may be selectively attached to the container 10. For example, the lid 12 may be connected to the container 10 by a threaded connection. In particular, as illustrated in FIGS. 2 and 15, the outer wall 18 of the lid 12 may include internal threads 20 and an upper portion 22 of the container may include external threads 24. The threads 20, 24 may allow the lid 12 to be selectively connected and disconnected from the container 10. It will be appreciated that the lid 12 and the container 10 may be connected in any suitable matter such as a friction fit, interference fit, snap fit, fasteners, clips, and the like. The lid 12 may also be permanently connected to the container 10 and, if desired, the container and lid may be integrally formed as part of a unitary, one-piece structure.

The container 10 may include a body 26 with a base or lower portion 28 and a central portion 30. The container 10 may include one or more markings or indicia 32, such as ounces or milliliters, which may indicate the amount of liquid or fluid in the container. For example, the container 10 may be sized and configured to hold 22, 24, 26 or 28 ounces but the container could be larger (e.g., 32 oz., 45 oz., 64 oz., 128 oz. or more) or smaller (e.g., 20 oz., 18 oz., 16 oz., 12 oz. or less). The markings 32 may extend along the side of the container 10 and the markings may be in customary units such as ounces or milliliters. It will be appreciated by one of ordinary skill in the art, after reviewing this disclosure, that the container 10 may have many different shapes, sizes, configurations, arrangements, features and aspects. Exemplary embodiments of containers, and various shapes, sizes, configurations, arrangements, features and aspects, that may be used with the container 10 are shown in U.S. Pat. Nos. D510,235; D677,121; D697,798; D727,097; 8,695,830; and 8,833,586; and U.S. Patent Publication Nos. 2014-0091086; 2014-0360908; each of which is incorporated by reference in its entirety.

As shown in FIG. 2, an agitator 34 may be disposed inside the container 10, if desired. The agitator 34 may be used to help mix the contents within the container 10. An exemplary embodiment of an agitator 34 that may be used in connection with the container 10 is shown in U.S. Pat. No. 6,379,032, which is incorporated by reference in its entirety. It will be understood that other types and configurations of agitators may be used, and that an agitator is not required.

Figure 7:
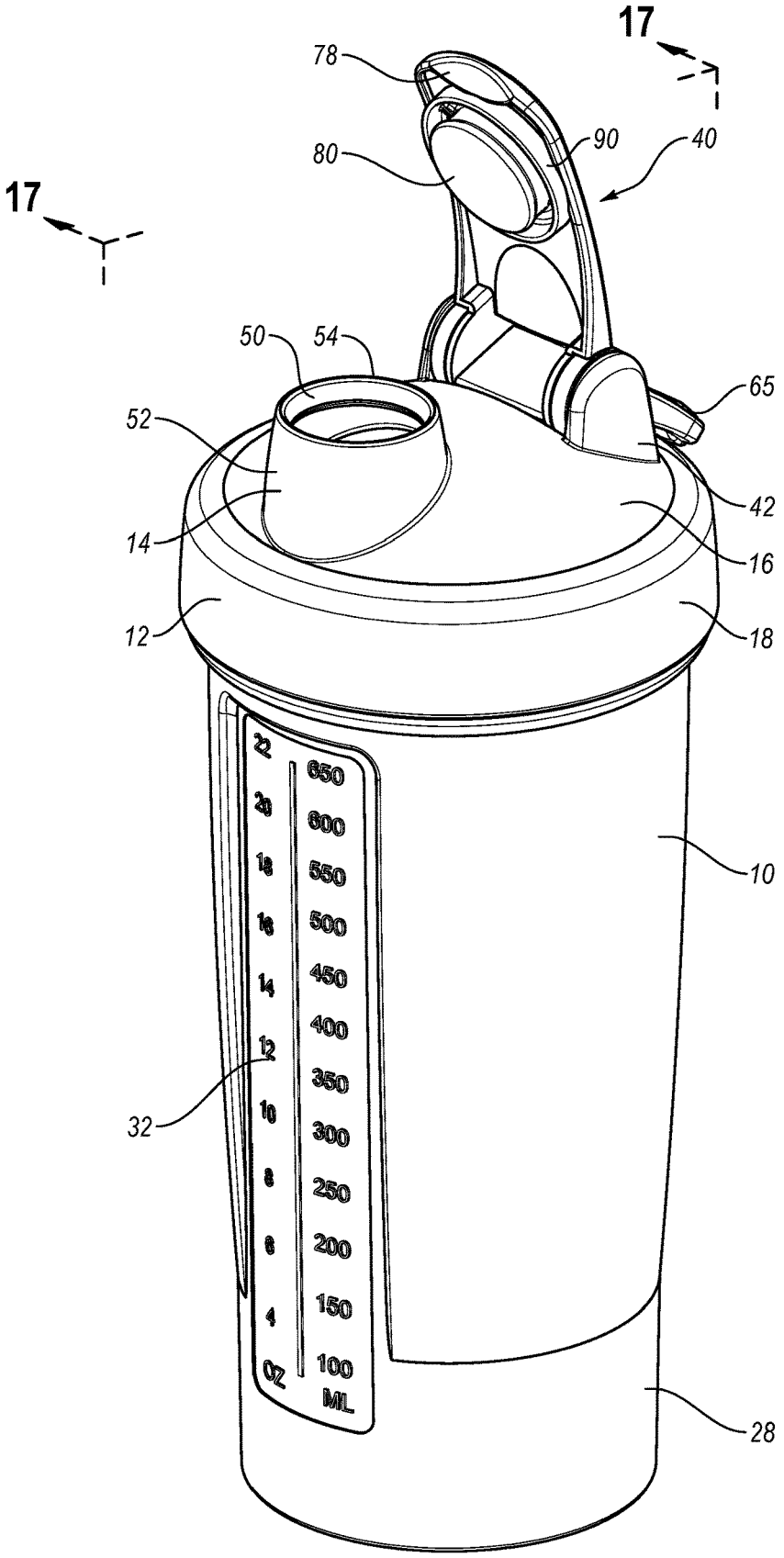
FIG. 7 is a perspective view of the container and lid shown in FIG. 1, illustrating the lid in an open position.
Figure 8:
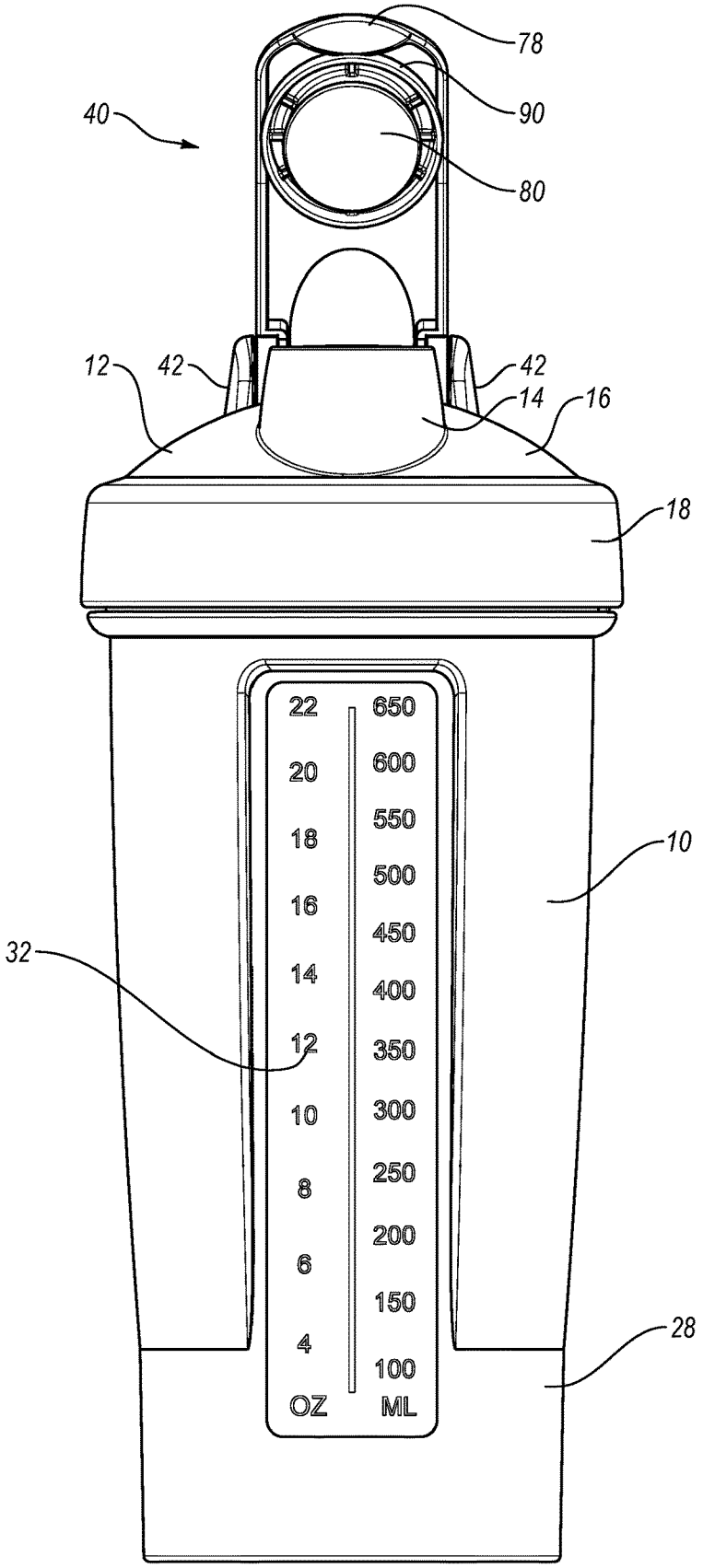
FIG. 8 is a front view of the container and lid shown in FIG. 7.

The lid 12 may include a flip-top closure 40 that is sized and configured to help control fluid flow through the opening or spout 14. When the flip-top closure 40 is in a closed position, as illustrated in FIG. 1, the spout 14 may be covered or closed to prevent fluid from exiting the container 10. The flip-top closure 40 may also be disposed in an open position, as illustrated in FIG. 7, which may allow fluid flow through the opening or spout 14.

In greater detail, the flip-top closure 40 may be pivotally connected to the lid 12. For instance, the lid 12 may include a pair of flanges 42 and the flip-top closure 40 may be rotatably connected to the flanges. A carrying member 44 may also be pivotally connected to the lid 12. In particular, the carrying member 44 may be pivotally connected to the lid 12 and the flip-top closure 40. Advantageously, the flip-top closure 40 and the carrying member 44 may pivot independently relative to the lid 12. The carrying member 44 may have a loop-shaped configuration and that may facilitate carrying of the container 10. The carrying member 44 may also facilitate attaching one or more items to the container 10 or lid 12, and/or attaching the container or lid to one or more items. If desired, the lid 12 may include one or more guides 46 to help control the movement of the flip-top closure 40 and/or carrying member 44. For example, the guide 46 may help control or limit the movement of the flip-top closure 40 and/or the carrying member 44.

The spout 14, which may be spaced apart from and on opposing sides of the upper surface 16 of the lid 12 from the flanges 42, may extend upwardly from the upper surface 16 of the lid 12. As shown in the accompanying figures, the spout 14 may have a circular or tubular-shaped configuration with an inner surface 50, an outer surface 52, and an upper surface 54. The inner and outer surfaces 50, 52 are preferably spaced apart by a generally constant distance and the spout may be tapered. For example, the spout 14 may taper slightly towards the upper surface 54. Thus, the base of the spout 14 may be slightly larger than the upper portion of the spout. The upper surface 54 of the spout 14 may have a planar surface and the upper surface may be disposed in a plane that is parallel to the upper portion of the lid 12. While the spout 14 is shown as having a circular configuration, the spout could have other suitable shapes, sizes, configurations, and arrangements. For example, the spout 14 could have an oval, oblong, or elongated shape. In addition, the spout 14 could include a lip or features, if desired.

As mentioned above, the flip-top closure 40 may be pivotally connected to the lid 12. For example, the flip-top closure 40 may include an end 56, which may be referred to as the proximal end for convenience, that is sized and configured to be connected to the flanges 42. In particular, as illustrated in FIG. 2, the flanges 42 may include one or more protrusions 58 that are inserted into one or more receiving portions 60 of the flip-top closure 40 and into one or more receiving portions 62 of the carrying member 44. Advantageously, this may allow the flip-top closure 40 and the carrying member 44 to be independently and rotatably connected to the lid 12. The proximal end 56 of the flip-top closure 40 may have a generally circular configuration and the lid 12 may include a flange 48.

The protrusions 58 of the flanges 42 may have a generally circular configuration. The receiving portions 60 of the flip-top closure 40 and the receiving portions 62 of the carrying member 44 may also have a generally circular configuration, which may allow the flip-top closure 40 and the carrying member 44 to pivot smoothly around the protrusions 58 of the flanges 42. As illustrated in FIG. 2, a diameter of the receiving portions 60 of the flip-top closure 40 may be at least approximately the same size as the receiving portions 62 of the carrying member 44. The diameter of the receiving portions 60 of the flip-top closure 40 and the diameter of the receiving portions 62 of the carrying member 44 may be larger than a diameter of each of the protrusions 58 of the flanges 42. The protrusions 58 of the flanges 42 may be coupled with the receiving portions 60 of the flip-top closure 40 and/or the receiving portions 62 of the carrying member 44 in any suitable manner such as a clearance fit, friction fit, interference fit, snap fit, and the like. The protrusions 58 may directly contact the receiving portions 62 of the carrying member 44 and the receiving portions 60 of the flip-top closure.

As illustrated in FIG. 2, the receiving portions 60 of the flip-top closure 40 may be disposed interior to the receiving portions 62 of the carrying member 44 when the protrusions 58 of the flanges 42 are inserted into the receiving portions 60 of the flip-top closure 40 and the receiving portions 62 of the carrying member 44. Advantageously, this may prevent one or more arms 64 of a loop-shaped portion 65 of the carrying member 44 from contacting the proximal end 56 of the flip-top closure 40 when the carrying member 44 and/or the flip-top closure 40 are rotated with respect to the lid, and thus, may allow the flip-top closure 40 and the carrying member 44 to be independently and rotatably connected to the lid 12. There are various ways in which the flip-top closure 40 and/or carrying member 44 may be pivotally connected to the lid 12, as explained later in further detail.

Figure 9:
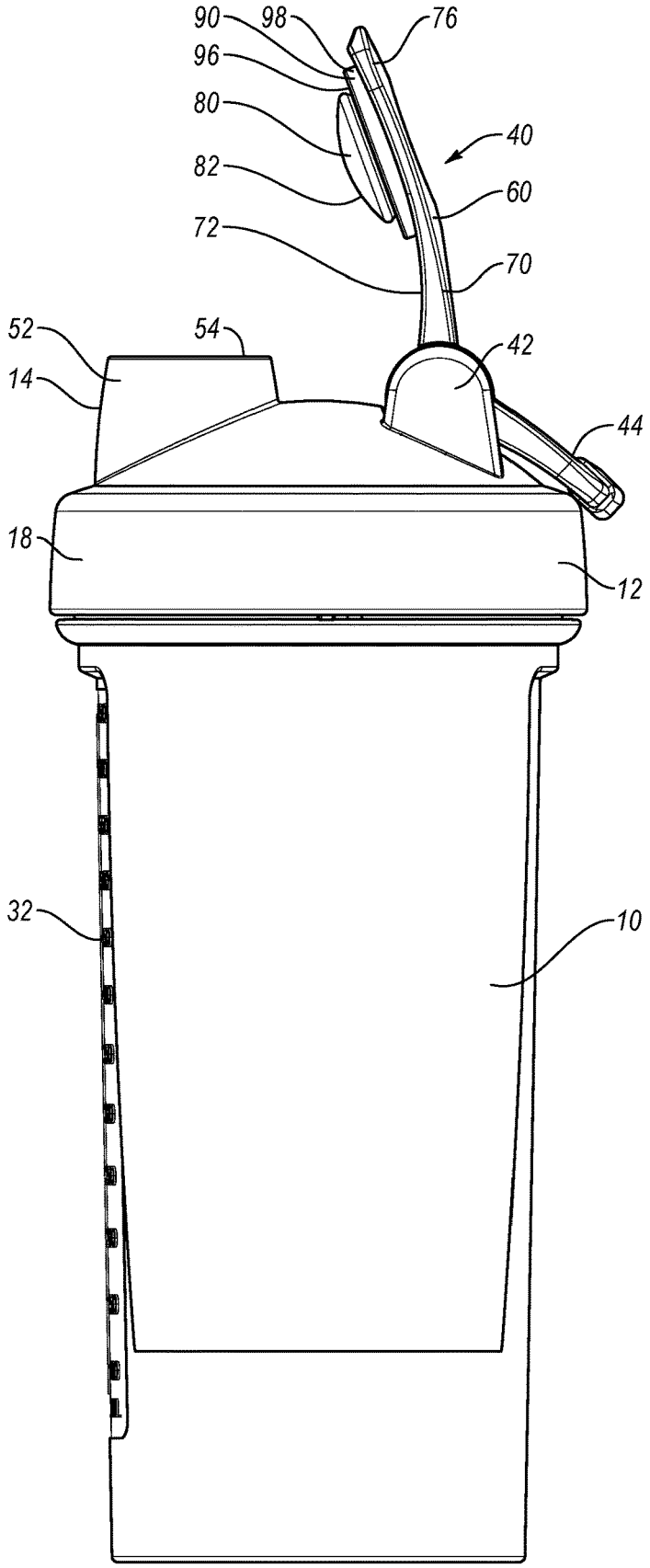
FIG. 9 is a right side view of the container and lid shown in FIG. 7.
Figure 10:
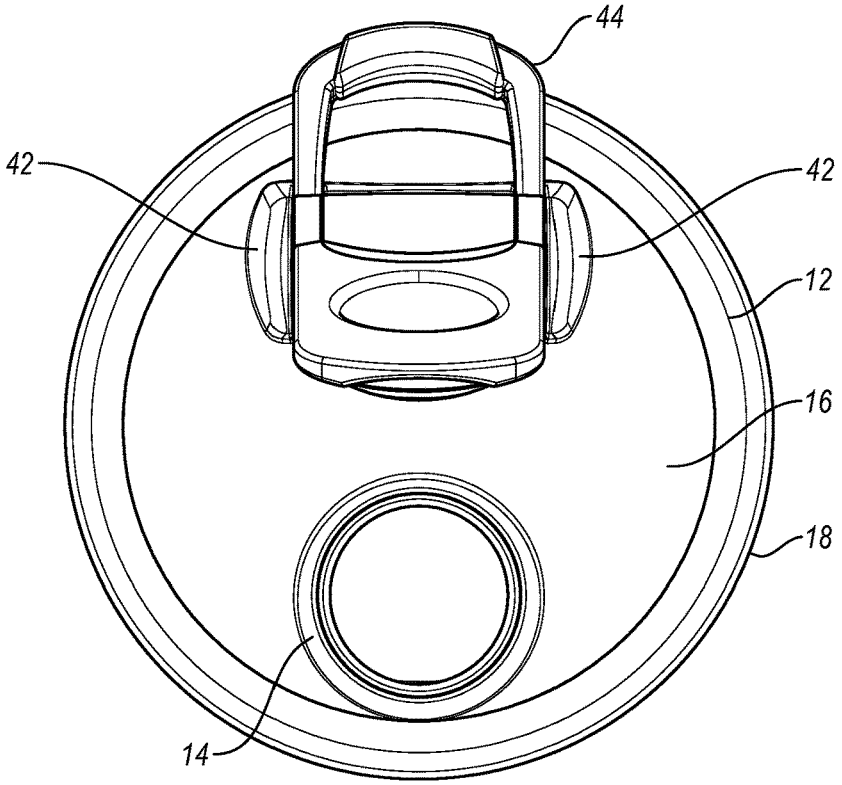
FIG. 10 is a top view of the container and lid shown in FIG. 7.
Figure 11:
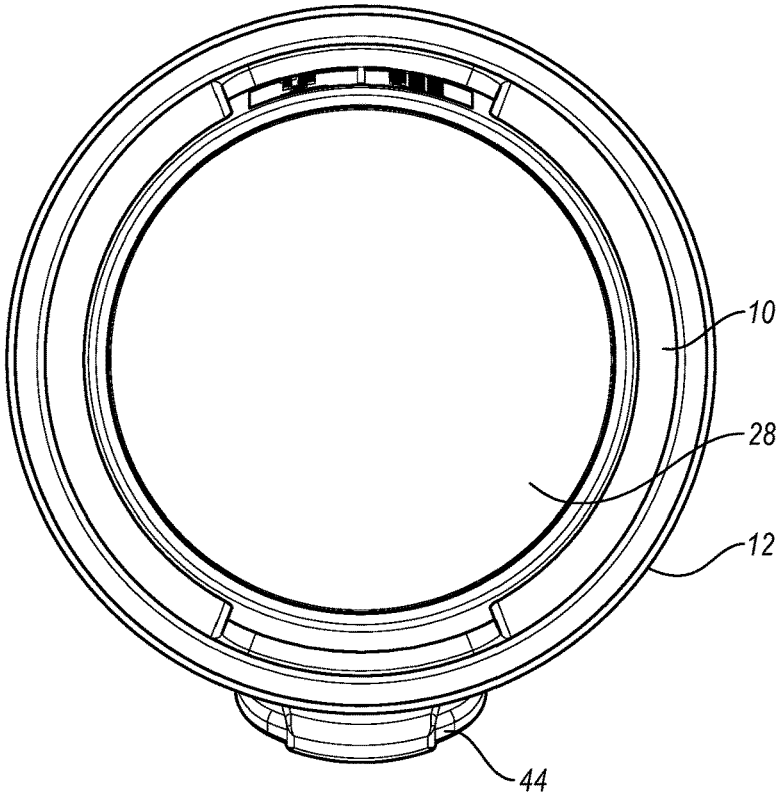
FIG. 11 is a bottom view of the container and lid shown in FIG. 7.

The flip-top closure 40 may include an elongated body 68 with an upper surface 70 and a lower surface 72, as illustrated in FIG. 9. The outer edge or perimeter of the body 68 may include a lip 74, which may extend downwardly from the lower surface 72, and the lip may have a curved and/or tapered outer surface. As illustrated in FIG. 7, the flip-top closure 40 may include an end 76, which may be referred to as the distal end for convenience, and a receiving portion 78, such as a recess, indentation, groove, or depression. The receiving portion 78 could be disposed in the lip 74 and, in particular, the receiving portion may be disposed in the distal end 76 of the flip-top closure 40. It will be understood that the receiving portion 78 may be disposed in any suitable location and the receiving portion could extend outwardly, such as a projection or protrusion, if desired.

The flip-top closure 40 may also include a fitting 80, such as a stopper, plug, cover, or the like, that is sized and configured to prevent fluid flow through the spout or opening 14 when the flip-top is in the closed position. In greater detail, the fitting 80 may be at least partially disposed in the spout 14 when the flip-top is disposed in the closed position. As shown in the accompanying drawings, the fitting 80 may extend downwardly from the body 68 of the flip-top closure 40 and the fitting may be disposed at least proximate the distal end 76 and/or the receiving portion 78 of the flip-top. The fitting 80 may include a lower surface 82 that is generally aligned with an inner surface of the lid 12 when the flip-top closure 40 is closed. Advantageously, this may help prevent items from being disposed or caught in the spout 14 when the flip-top closure 40 is closed. The fitting 80 may also include an engaging portion 84 that is sized and configured to engage an engaging portion 86 on the inner surface 50 of the spout 14, which may help retain and/or secure the flip-top closure 40 in the closed position and/or may help create a fluid-tight seal.

When the flip-top closure 40 is in the closed position, the fitting 80 may be at least partially disposed in the spout 14 and, if desired, an outer surface 88 of the fitting 80 may contact or engage the inner surface 50 of the spout 14. In addition, the engaging portion 84 of the fitting 80 and the engaging portion 86 of the spout 14 may contact or engage. Further, the upper surface 54 of the spout 14 may contact or engage the lower surface 72 of the body 68 of the flip-top closure 40. The interaction of one or more of these surfaces may allow the flip-top closure 40 to be securely closed and/or may help create a fluid-tight seal. If desired, one or more gaskets, seals, washers, linings, and the like may be disposed between one or more of these surfaces, which may also help secure the flip-top closure 40 in a closed position and/or help create a fluid-tight seal.

Figure 12:
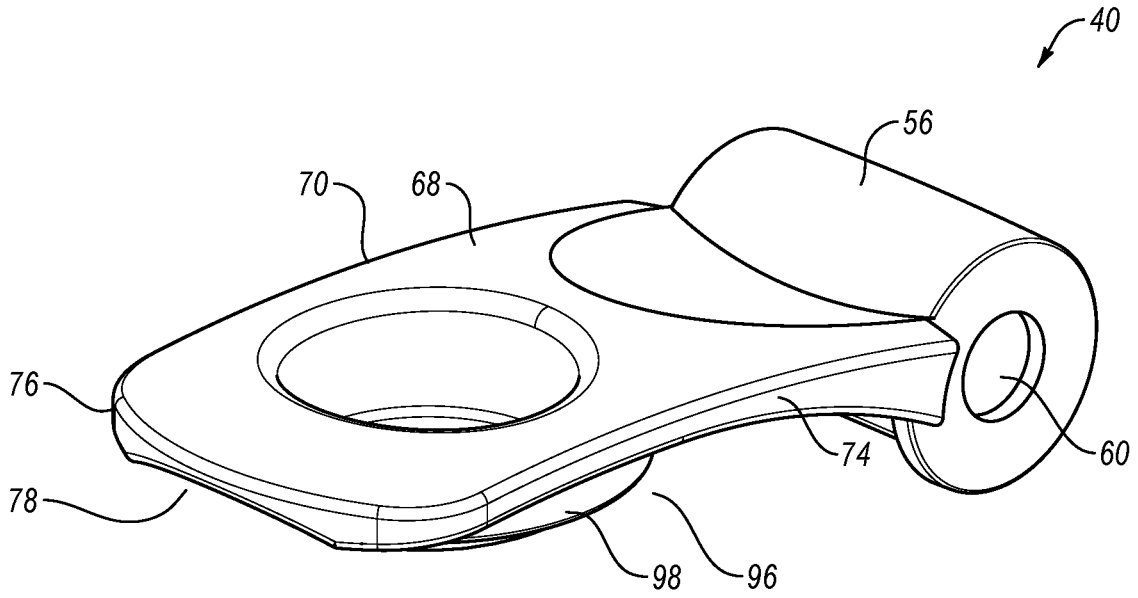
FIG. 12 is an upper perspective view of a flip-top closure of the container and lid shown in FIG. 1.
Figure 13:
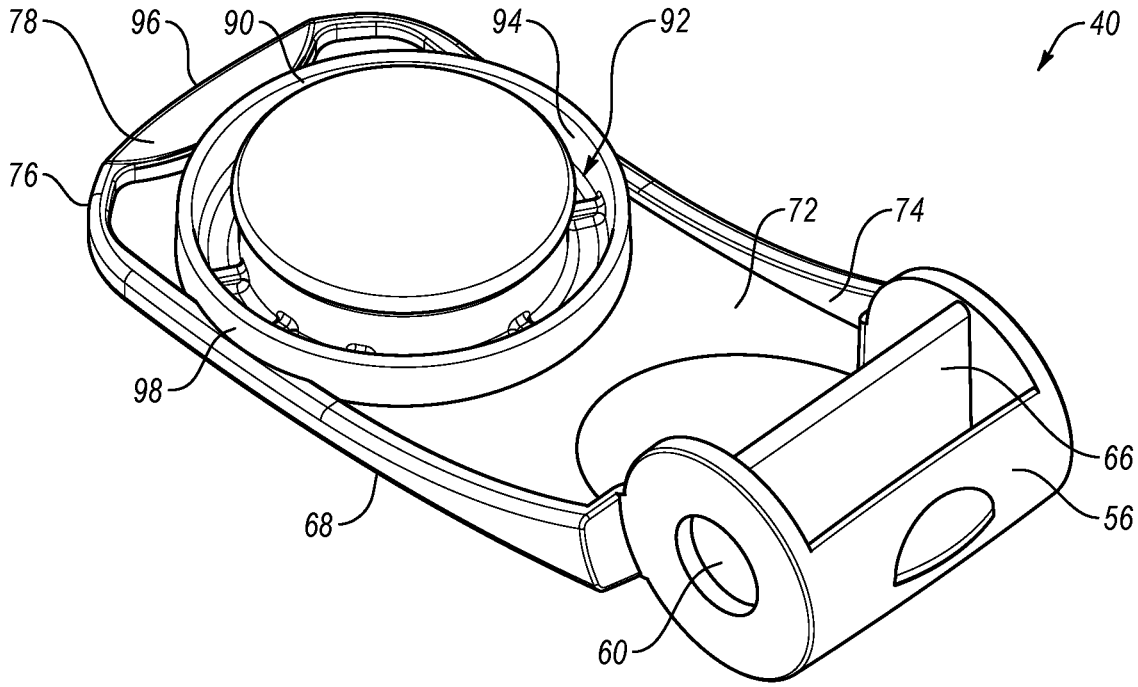
FIG. 13 is a lower perspective view of the flip-top closure shown in FIG. 12.
Figure 14:
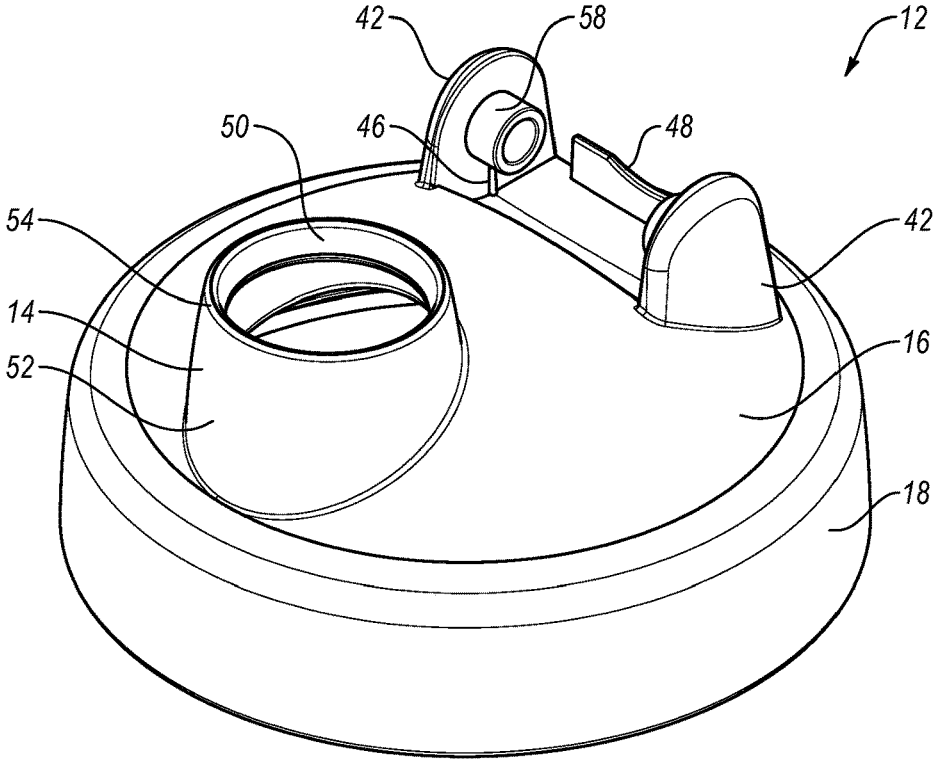
FIG. 14 is an upper perspective view of a lid of the container and lid shown in FIG. 1.

A protecting member 90, such as a guard, may be sized and configured to prevent contact with the spout 14 and/or the fitting 80. In particular, the protecting member 90 may be sized and configured to help prevent a user from touching or contacting at least a portion of the spout 14 and/or the fitting 80. For example, as best seen in FIGS. 7, 12, and 13, the protecting member 90 may be at least partially disposed about or around the fitting 80. In greater detail, the protecting member 90 may at least partially enclose, encircle, or encompass the fitting 80, and the protecting member and fitting may have conforming or corresponding shapes. For instance, if the fitting 80 has a generally cylindrical configuration, then the protecting member 90 may also have a generally cylindrical configuration. As shown in the accompanying figures, the protecting member 90 may have a larger diameter than the fitting 80 so that the fitting is disposed within the protecting member.

The protecting member 90 and the fitting 80 may be spaced apart by a gap 92 and the gap may have a generally constant size and configuration. For example, the gap 92 may have a cylindrical or tubular-shaped configuration and the gap may be sized and configured to allow the upper portion of the spout 14 to be disposed between the protecting member 90 and the fitting 80 when the flip-top closure 40 is closed. In particular, the gap 92 may be sized and configured to allow the upper portion of the spout 14 to be sandwiched between the protecting member 90 and the fitting 80 when the flip-top closure 40 is closed. In this exemplary configuration, the gap 92 may have a size that is generally equal to or slightly larger than the width of an edge of the spout 14. Thus, the protecting member 90 and the gap 92 may form a shield around at least a portion of the spout 14.

In greater detail, the protecting member 90 may include an inner surface 94 that encircles at least a portion of the outer surface 88 of the fitting 80. The protecting member 90 may also include a lower surface 96 and the lower surface may conform or correspond to the upper surface 16 of the lid 12. For instance, if the upper surface 16 of the lid 12 is doomed or curved, the lower surface 96 of the protecting member 90 may be curved or rounded to correspond to the shape of the lid. In addition, the protecting member 90 may include an outer surface 98 and the outer surface may be disposed at least proximate the receiving portion 78 in the end 76 of the flip-top closure 40. For example, the receiving portion 78 may be disposed adjacent to the outer surface 98 of the protecting member 90.

After reviewing this disclosure, one of ordinary skill in the art will understand that the protecting member 90 may have other suitable shapes, shapes, configurations and arrangements depending, for example, upon the size and shape of the flip-top closure 40 and/or the fitting 80. For example, the protecting member 90 may protect all or only a portion of the spout 14 and/or the fitting 80. One of ordinary skill in the art will also understand that the lid 12 may include other features and aspects such as those shown in U.S. Pat. Nos. D510,235; D626,837; D626,838; D677,121; D696,551; 8,695,830; and 8,833,586; and U.S. patent publication nos. 2014-0091086; 2014-0360908; each of which is incorporated by reference in its entirety.

The container 10 and the lid 12 may be constructed from durable, long-lasting materials. The container 10 and the lid 12 may also be constructed from materials that may be reused and/or recycled. The container 10 and the lid 12 may, for example, be constructed from a relatively rigid material such as plastic. In particular, the container 10 and the lid 12 may be constructed from materials such as high-density polyethylene ("HDPE") or other materials with similar properties and/or characteristics. In view of this disclosure, one of ordinary skill in the art will appreciate that the container 10 and the lid 12 may be constructed from various materials with desired properties such as different types of plastics, glass, metal, composites, and the like. Additionally, the container 10 and the lid 12 may be constructed from at least partially transparent or translucent materials, which may allow the user to see the type and/or amount of fluids in the container.

In operation, a user may apply a force to open the flip-top closure 40. For example, a user may apply a force to the distal end 76 to open the flip-top closure 40. In greater detail, a user may apply a force to the receiving portion 78 located at the distal end 76 of the flip-top closure 40. Advantageously, the receiving portion 78 may indicate when a user should apply a force and the receiving portion may help facilitate opening of the flip-top closure 40. When a user uses his or her thumb or finger to open the flip-top closure 40, the protecting member 90 may help prevent the user from touching or contacting the spout 14 or the fitting 80. That is, the user may only touch a portion of the distal end 76 of the flip-top closure 40, such as the receiving portion 78, and/or the protecting member 90 when opening the flip-top closure. Significantly, the user may not touch any other portion of the lid 12. Because the only portions of the lid 12 that may be touched while opening the flip-top closure 40 may be the distal end 76, the receiving portion 80, and/or the protecting member 90, there may be no contact with the spout 14, the fitting 80, and/or other portions of the opening or lid. This may facilitate use of the flip-top closure 40 when a user's hands may be unclean or unwashed, wearing gloves, sweaty or perspiring, and the like. Importantly, this may facilitate use of the flip-top closure 40 in environments such as exercising, bodybuilding, gardening, construction, repairing, cleaning, wearing gloves, and the like where it may be desirable not to touch the spout 14, the fitting 80, or other surfaces of the flip-top.

Advantageously, the lid 12 may be simple to use and operate. In addition, the lid 12 may be quickly and easily assembled, cleaned, and disassembled. Further, the lid 12 may be efficiently manufactured, easily repaired, and/or conveniently replaced.

There are various ways in which the flip-top closure 40 and/or the carrying member 44 may be pivotally connected to the lid 12. For example, as best seen in FIGS. 18-21 and FIG. 23, an inner portion of the receiving portions 62 of the carrying member 44 may include one or more protrusions 100 that are inserted into the receiving portions 60 of the flip-top closure 40. The protrusions 58 of the flanges 42 may be inserted into the receiving portions 62 of the carrying member 44. Advantageously, this configuration may allow the flip-top closure 40 and the carrying member 44 to be independently and rotatably connected to the lid 12.

In further detail, when the protrusions 58 of the flanges 42 are inserted into the receiving portions 62 of the carrying member 44, the protrusions 58 of the flanges 42 may extend through at least a portion of the receiving portions 62 of the carrying member 44. The protrusions 58 of the flanges 42 may also extend through at least a portion of the receiving portions 60 of the flip-top closure 40. The protrusions 58, however, may directly contact the receiving portions 62 of the carrying member 44 but may not directly contact the receiving portions 60 of the flip-top closure.

The protrusions 58 of the flanges 42 may have a generally circular configuration. The receiving portions 60 of the flip-top closure 40 and the receiving portions 62 of the carrying member 44 may also have a generally circular configuration, which may allow the flip-top closure 40 and the carrying member 44 to pivot smoothly around the protrusions 58 of the flanges 42. A diameter of the receiving portions 60 of the flip-top closure 40 may be larger than a diameter of the protrusions 100 of the receiving portions 62 of the carrying member 44. The diameter of the protrusions 100 of the receiving portions 62 may be larger than a diameter of the protrusions 58 of the flanges 42. Also, the protrusions 100 of the receiving portions 62 of the carrying member 44 and the receiving portions 60 of the flip-top closure 40 may be configured to connect the carrying member 44 and the flip-top closure 40 in any suitable matter such as a clearance fit, friction fit, interference fit, snap fit, and the like. The protrusions 58 of the flanges 42 and the receiving portions 62 of the carrying member 44 may be configured to connect the carrying member 44 and the lid 12 in any suitable manner such as a clearance fit, friction fit, interference fit, snap fit, and the like.

Figure 20:
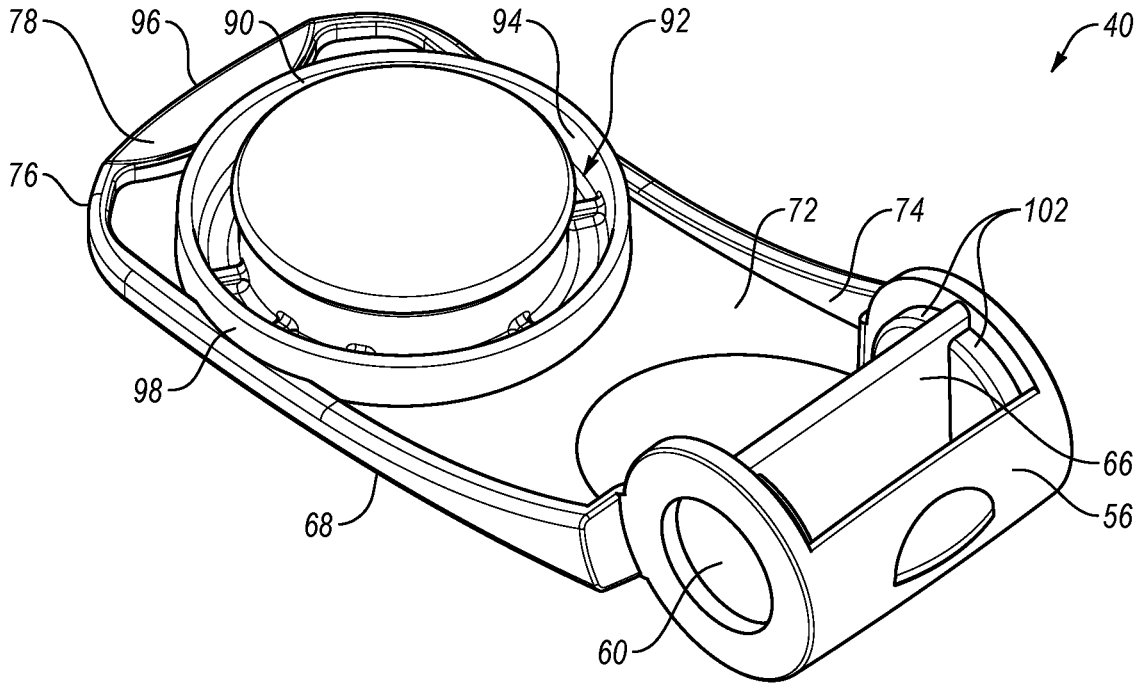
FIG. 20 is a lower perspective view of the flip-top closure shown in FIG. 19.
Figure 21:
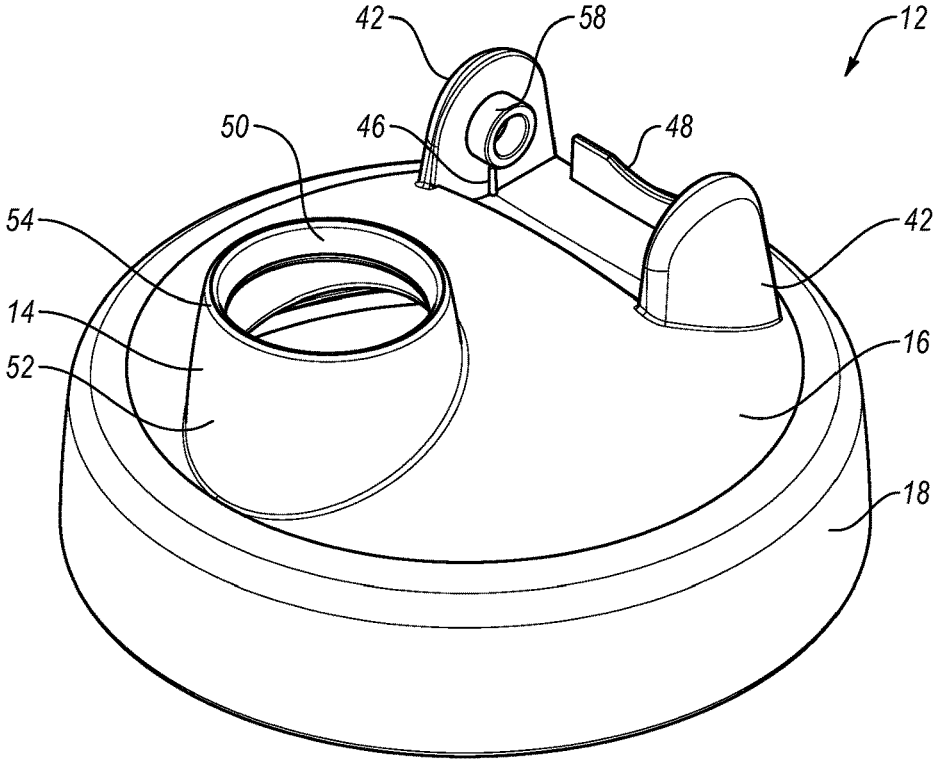
FIG. 21 is an upper perspective view of a lid of the container and lid shown in FIG. 18.
Figure 22:
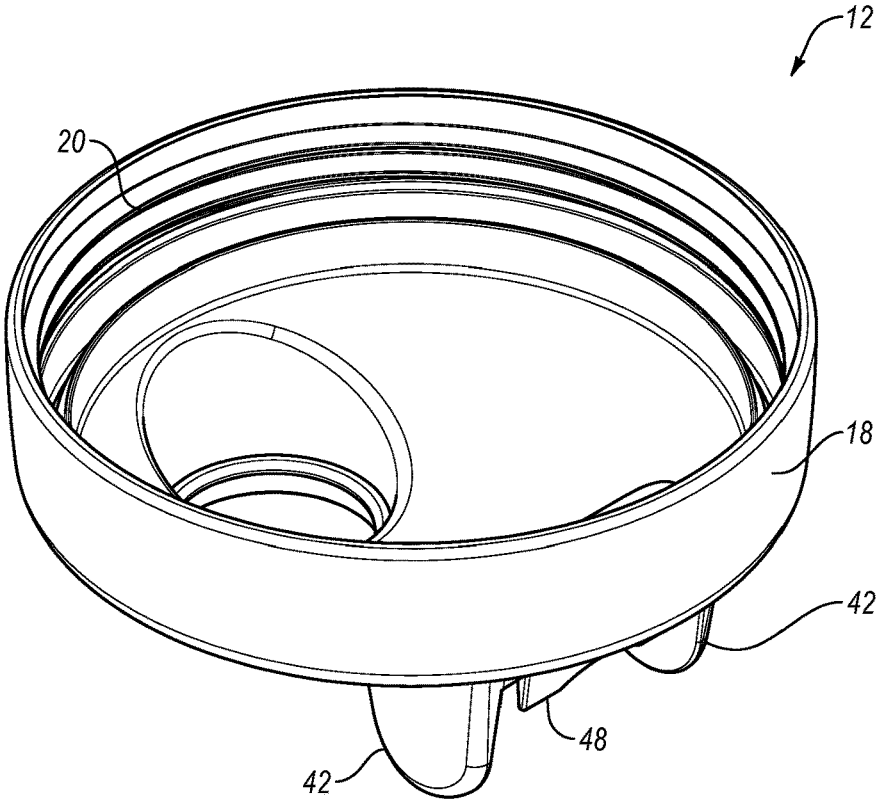
FIG. 22 is a lower perspective view of the lid shown in FIG. 21.
Figure 23:
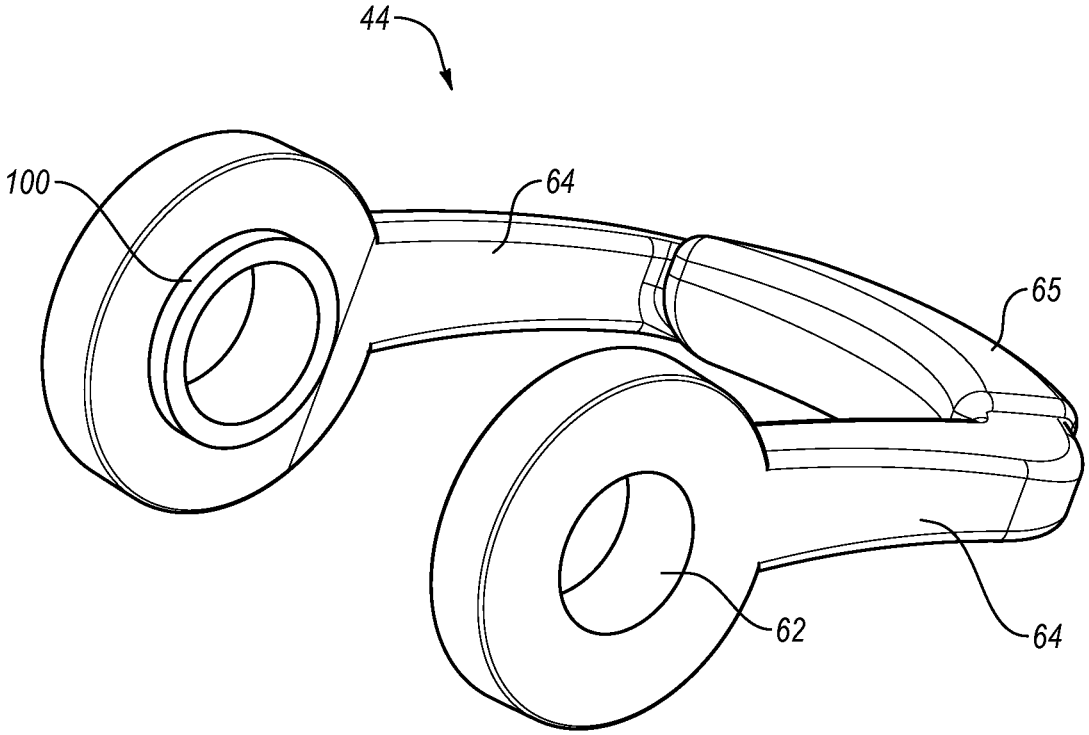
FIG. 23 is an upper perspective view of a carrying member of the container and lid shown in FIG. 18.

As illustrated in FIG. 20, the receiving portions 60 of the flip-top closure 40 may include one or more depressions 102, which may be one or more receiving portions, grooves, channels, indentations, and the like. The protrusions 100 may be disposed within the depressions 102 when the protrusions of the receiving portions 62 are inserted into the receiving portions 60 of the flip-top closure 40. The depressions 102 may support the engaging portion 66 of the proximal end 56, which may be disposed between the depressions 102.

The receiving portions 60 of the flip-top closure 40 may be disposed interior to the receiving portions 62 of the carrying member 44 when the protrusions 58 of the flanges 42 are inserted into the receiving portions 60 of the flip-top closure 40 and the receiving portions 62 of the carrying member 44. Advantageously, this may prevent one or more arms 64 of a loop-shaped portion 65 of the carrying member 44 from contacting the proximal end 56 of the flip-top closure 40 when the carrying member 44 and/or the flip-top closure 40 are rotated with respect to the lid, and thus, may allow the flip-top closure 40 and the carrying member 44 to be independently and rotatably connected to the lid 12.

The present invention may be embodied in other specific forms without departing from its spirit or essential characteristics. The described embodiments are to be considered in all respects as only illustrative and not restrictive. The scope of the invention is, therefore, indicated by the appended claims, rather than by the foregoing description. All changes which come within the meaning and range of equivalency of the claims are to be embraced within their scope.

What is claimed is:

1. A lid sized and configured to be attached to a container, the container sized and configured to be filled with one or more fluids, the lid comprising:

a spout;

a flip-top closure movable between an open position and a closed position relative to the spout;

a carrying member with a loop-shaped configuration; and a flange that includes a protrusion, wherein:

the protrusion forms a pivot point around which the flip-top closure pivots between the open position and the closed position and around which the carrying member pivots independently of the flip-top closure;

the flip-top closure includes a receiving portion; and the protrusion extends through a receiving portion of the carrying member into the receiving portion of the flip-top closure.

2. The lid of claim 1, wherein the carrying member includes a receiving portion, wherein the protrusion of the flange is also disposed in the receiving portion of the carrying member.

3. The lid of claim 2, wherein:

the receiving portion of the flip-top closure and the receiving portion of the carrying member each have a circular configuration; and a diameter of the receiving portion of the flip-top closure is equal to a diameter of the receiving portion of the carrying member.

4. The lid of claim 2, wherein the receiving portion of the flip-top closure is interior to the receiving portion of the carrying member.

5. The lid of claim 1, wherein a diameter of the protrusion of the flange is constant along a length of the protrusion.

6. A lid and container system, comprising:

a container sized and configured to be filled with one or more fluids; and a lid sized and configured to be attached to the container, the lid comprising:

a first flange, wherein the first flange includes a first protrusion;

a second flange, wherein the second flange includes a second protrusion;

a spout;

a flip-top closure, wherein the flip-top closure is movable about a pivot axis between an open position and a closed position relative to the spout, wherein the pivot axis is aligned with the first protrusion and the second protrusion and wherein the flip-top closure includes a first receiving portion and a second receiving portion; and a carrying member comprising first and second ends and a loop that extends between the first and second ends, the first and second ends positioned between the first flange and the second flange;

wherein:

the carrying member is movable about the pivot axis;

the first protrusion of the first flange extends through the first end of the carrying member at least partially into the first receiving portion of the flip-top closure; and the second protrusion of the second flange extends through the second end of the carrying member at least partially into the second receiving portion of the flip-top closure.

7. The lid and container system of claim 6, wherein the first and second receiving portions of the flip-top closure are interior to the first and second ends of the carrying member.

8. The lid and container system of claim 6, wherein a diameter of each of the first and second protrusion of the first and second flanges is constant along a length of the corresponding first and second protrusion.

9. The lid and container system of claim 6, wherein:

the first end of the carrying member includes a first receiving portion;

the second end of the carrying member includes a second receiving portion;

the first protrusion of the first flange is disposed in the first receiving portion of the first end of the carrying member; and the second protrusion of the second flange is disposed in the second receiving portion of the second end of the carrying member.

10. The lid and container system of claim 9, wherein:

the first receiving portion of the flip-top closure and the first receiving portion of the first end of the carrying member each have a circular configuration; and a diameter of the first receiving portion of the flip-top closure is equal to a diameter of the first receiving portion of the carrying member.

11. A lid sized and configured to be attached to a container, the container sized and configured to be filled with one or more fluids, the lid comprising:

a first flange;

a first protrusion disposed on the first flange;

a second flange;

a second protrusion disposed on the second flange, wherein the first protrusion extends from the first flange toward the second protrusion, and wherein the second protrusion extends from the second flange toward the first protrusion;

a spout;

a flip-top closure having an end portion disposed between the first flange and the second flange, wherein the flip-top closure is movable about a pivot axis between an open position and a closed position relative to the spout, wherein the pivot axis extends through the first protrusion, the second protrusion, and the end portion of the flip-top closure; and a carrying member with a loop-shaped configuration, wherein the carrying member is movable about the pivot axis, wherein the carrying member has a first end portion disposed between the first flange and the end portion of the flip-top closure, wherein the carrying member has a second end portion disposed between the second flange and the end portion of the flip-top closure, wherein the end portion of the flip-top closure includes a first receiving portion and a second receiving portion, wherein the first protrusion extends through a receiving portion of the first end portion of the carrying member and is received in the first receiving portion of the flip-top closure, wherein the second protrusion extends through a receiving portion of the second end portion of the carrying member and is received in the second receiving portion of the flip-top closure, and wherein together the end portion of the flip-top closure, the first end portion of the carrying member, and the second end portion of the carrying member occupy the entire distance between the first flange and the second flange.

12. The lid of claim 11, wherein the first and second receiving portions of the carrying member and the first and second receiving portions of the flip-top closure each have a circular configuration and a same diameter.

13. The lid of claim 11, wherein the first and second protrusions each has a constant diameter along a length thereof.

14. The lid of claim 11, further comprising a guide configured to control movement of the flip-top closure, wherein:

an engaging portion of the end portion of the flip-top closure interacts with the guide;

the first receiving portion of the flip-top closure includes a depression; and the depression supports the engaging portion of the end portion of the flip-top closure.

* * * * *